US005469592A

United States Patent [19]

Johnson

[11] Patent Number: 5,469,592

[45] Date of Patent: Nov. 28, 1995

[54] GEOMETRICALLY EFFICIENT SELF-INFLATING SEAT CUSHION

[76] Inventor: Mark C. Johnson, 32 Galen Ct., Seekonk, Mass. 02771-1206

[21] Appl. No.: 126,552

[22] Filed: Sep. 27, 1993

Related U.S. Application Data

[63] Continuation-in-part of Ser. No. 78,754, Jun. 16, 1993.

[51] Int. Cl.[6] ..... A47C 27/08

[52] U.S. Cl. ..... 5/654; 5/450; 297/DIG. 3; 36/43

[58] Field of Search ..... 5/450, 449, 420, 5/455, 654, 653; 297/DIG. 1, DIG. 3; 36/43, 29

[56] References Cited

U.S. PATENT DOCUMENTS

| | | | |
|---|---|---|---|
| 1,266,482 | 5/1918 | Kamrass | 5/450 |
| 2,039,289 | 5/1936 | Bergeron | 5/455 |
| 2,521,530 | 9/1950 | McGuffage | 5/630 |
| 2,750,606 | 6/1956 | Freedlander et al. | 5/450 |
| 2,822,554 | 2/1958 | Wenzelberger | 5/450 |
| 2,886,834 | 5/1959 | Gilbertson | 5/450 |
| 3,017,642 | 1/1962 | Rosenberg | 5/349 |
| 3,362,032 | 1/1968 | Summers | 5/450 |
| 3,421,163 | 1/1969 | Stoughton | 5/450 |
| 3,798,686 | 3/1974 | Gaiser | 5/343 |
| 3,864,766 | 2/1975 | Prete, Jr. | 5/450 |
| 3,877,092 | 4/1975 | Gaiser | 5/343 |
| 5,167,999 | 12/1992 | Wang | 36/43 |

FOREIGN PATENT DOCUMENTS

| | | | |
|---|---|---|---|
| 929287 | 6/1973 | Canada | 297/DIG. 3 |

*Primary Examiner*—Alexander Grosz

[57] ABSTRACT

A self-inflating seat cushion is shown with airtight hollow body 32 comprising flexible material and resilient structure member 30 comprising foam. Hollow, resilient structure member 30, made of flat portions of material, can lie on the inside or attach to the outside of airtight hollow body 32. During inflating, resilient structure member 30 expands moving airtight hollow body 32 into an arching configuration with high volume relative to its dimensions. A proportionate volume of air flows into the chamber. During use, the chamber flattens and deforms, airtight hollow body 32's volume diminishes, its internal pressure increases proportionately, and the seat cushions and supports weight.

4 Claims, 22 Drawing Sheets

GEOMETRICALLY EFFICIENT SELF-INFLATING SEAT CUSHION

CROSS-REFERENCE TO RELATED INVENTIONS

The present invention is a continuation-in-part of my copending application titled Auto-Inflating Cushion, App. No. 08/078,754, filed Jun. 16, 1993.

FIELD OF INVENTION

This invention relates to inflatable cushions, supports, pillows, mattresses, and more particularly to like articles that self-inflate with resilient members.

DISCUSSION OF PRIOR ART

The inflating method has been a shortcoming in the design of fluid fillable products. Most fluid fillable products assume the use of the common inflating methods: A) Blow-up valve systems B) Pump and compressor systems.

There are many negative characteristics of blow-up valve systems. First, putting a blow-up valve in one's mouth is unhygienic. This is true even if the article is used exclusively by a single person. Second, the blower's ears can experience popping and discomfort during inflation. Third, depending on the volume of air required to fill the article, the blower may be subject to hyperventilation. Fourth, also depending on the volume of air required, blowing up an inflatable article can be too time consuming.

Pump and compressor systems have their own negative characteristics. First, these tend to be expensive and can add considerably to the cost of an inflatable article. A pump or compressor can often make an inflatable article uneconomical to produce and sell.

Second, pumps and compressors can be heavy and usually tend to be bulky. These qualities are especially negative when associated with inflatable articles. Inflatable articles are often used precisely because they are light and collapsible. These benefits will be at least partially defeated if the inflating system is heavy and bulky. For example, a portable air mattress may no longer be very portable once a pump or compressor is added to the package.

If a pump is compact, not bulky, then it probably is only suitable for inflating small volumes. Inflating a large volume probably would be too time consuming.

Less common approaches to inflating fluid fillable articles have their own drawbacks. Fostering chemical reactions that release a gas has been used to inflate various flexible bodies. However, these systems generally require the replacement of chemicals after use. Using springs, bellows, and the like to inflate air chambers has been applied in various forms. However, these systems are generally heavy and bulky.

Prior Art Showing Self-Inflating Air Pads

The air pads shown in the prior art that use a foam or other resilient structure member to self-inflate have more subtle differences and deficiencies. The prior art does not use geometry as effectively as described herein. Thus the prior art espouses designs that are less geometrically efficient than the shapes described in the air pad presented. This subsection will discuss this category of prior art.

Geometrically efficient chambers can be described as hollow bodies that have a large volume given their surface area and plan dimensions. (For the purposes of this invention, geometric efficiency is technically defined for two-dimensional vertical cross-sections.) The geometric efficiency of an inflatable pad strongly affects its weight supporting capacity.

The predominant prior art shows flat sections of foam that are laid flat in airtight envelopes. For example, to achieve a cushion that is rectangular in plan, the prior art usually takes a substantially box-like section of foam and simply envelops it airtightly. Box-like and flat shapes do not enclose the maximum amount of volume given a certain surface area of material and certain plan dimensions. Thus the mainstream prior art does not achieve maximum volumes and hence maximum inflating.

The prior art, with few exceptions, does not shape the foam and shape the airtight envelope to create curved volumes that are very geometrically efficient. Most geometrically efficient curvature occurs as the foam or filler gets pinched at the edges. In other words, some degree of geometric efficiency occurs incidentally. This logically explains why the prior art's most geometrically efficient air pads are smaller cushions. It also logically explains why very geometrically efficient shapes are not found in the prior art's larger air mattresses.

A very efficiently shaped pillow was found in Prete's U.S. Pat. No. 3,864,766. In U.S. Pat. No. 1,266,482, Kamrass showed a seat cushion with such very efficient geometry. However, both examples substantially packed their geometrically efficient volumes with their respective resilient fillers. Thus the prior art did not allow the air to primarily sustain the weight of the user. Therefore, there is no evidence that the prior art recognized that the air primarily, and substantially alone, could well sustain the weight of the user. In sum, these examples of prior art neither fully recognized nor wholly applied their degree of geometric efficiency.

The prior art does have examples of cushions, supports, and mattresses where the resilient, self-inflating member, does not substantially fill the unit. Copeland's Canadian Patent 929,287 shows a somewhat hollowed cushion or support. Gilbertson's U.S. Pat. No. 2,886,834 shows a mattress that self-inflates with hollow, resilient tubes. However, these examples of prior art do not show very high geometric efficiencies. They did not show the dramatic improvement and worthwhileness of a slight, though calculatedly controlled, curvature. The prior art employed billowing shapes emphasizing the amount of air and not the compression of air. The prior art did not let low, arching volumes of air do the job of cushioning and supporting. Nor did the prior art advocate this. Therefore, there is no evidence that the prior art recognized how well a thin, very geometrically efficient layer of air, largely alone, could support and cushion.

By not having a hollow self-inflating filler along with a very high geometric efficiency, the prior art never applied a high geometric efficiency where the air clearly supported the weight. In conclusion, the prior art neither applied very geometrically efficient shapes that were primarily air pads, nor adequately recognized the benefits.

In the prior art, the foam and envelope tend not to increase and decrease gradually in height when in the fully inflated state. The prior art air pads tend to start out at a steep angle and then level off to a substantially flat supporting surface. These inefficient shapes can allow excessive pinching through so that the pad becomes less of an air cushion and more of a foam cushion. Air cushions have distinct advantages. Inefficiently shaped, self-inflating air pads can lose these advantages.

Inefficiently shaped air pads also can cause bunching of material. This is logical since there is less volume or, seen another way, excess material. Excess material means there is more material to purchase. Perhaps more importantly, excess material means there is more material to stretch. A degree of stretching resistance is a requirement of inflatable air pads.

The disadvantage of the foregoing Auto-Inflating Cushion is the need to erect stiffened end panels. Also, if these end panels are truly rigid, then they may cause discomfort in some situations.

OBJECTS AND ADVANTAGES

Articles that self-inflate refers to sealed hollow bodies that naturally fill with air when the hollow body expands to increase its internal volume. The broad object of the invention is to provide related articles that self-inflate by the expansion of resilient materials.

The more specific object of the invention is to create air pads as aforementioned that are highly efficient in shape. This means that vertical cross-sections of these hollow bodies forms a shape with greatly more area than a rectangle having the same perimeter and same base width, where base width is the maximum width of the shape. Geometric efficiency has many benefits.

Another specific object of the invention is to provide air pads that are adequately inflated. This means that the inflating air provides primary support. This is a benefit of geometric efficiency.

Another specific object of the invention is to provide air pads where the material does not bunch inconveniently.

Another specific object of the invention is to provide self-inflatable air pads where a reduction in the airtight chamber material minimizes its stretching.

Another specific object of the invention is to provide self-inflatable air pads that are stable due to their low profile.

Another specific object of the invention is to provide self-inflatable air pads that corral and compress inflating air more effectively.

Another specific object of the invention is to provide air pads that are appropriate in shape. Some applications will warrant more efficient shapes than others.

Another specific object of the invention is to provide air pads as aforementioned that function as portable seat cushions and seat cushions for use on bicycles.

Another specific object of the invention is to provide self-inflating back rests and lumbar supports.

Another specific object of the invention is to provide air pads that feel soft and pleasant.

Another specific object of the invention is to provide air pads that offer a wide, unobstructed cushioning surface.

Another specific object of the invention is to provide air pads that conform better to the contours of that which is being padded.

Another specific object of the invention is to provide air pads that function as mattresses.

Another specific object of the invention is to provide air pads that are easy and convenient to use.

Another specific object of the invention is to provide air pads as aforementioned that collapse for portability and storage.

Another specific object of the invention is to provide air pads as aforementioned that are lightweight for portability and transportation.

Another specific object of the invention is to provide air pads as aforementioned where the inflating level can be adjusted by releasing inflating air.

Another specific object of the invention is to provide air pads as aforementioned that offer healthful benefits. This invention has uses in areas of health care. The inflating process presents no hygiene problem.

Another specific object of the invention is to provide air pads as aforementioned that can be inflated and deflated repeatedly.

Another specific object of the invention is to provide air pads as aforementioned that can be produced economically.

Further objects and advantages of the invention will become apparent from a consideration of the following drawings and descriptions.

REFERENCE NUMERALS IN DRAWINGS

30) Resilient structure member.
31) Substantial hollow.
32) Airtight hollow body.
34) Top section.
36) Base section.
38) End sections.
40) Geometrically efficient arching shape.
42) Corresponding rectangle.
44) Top section flange.
46) Base section flange.
47) Hollow body opening.
48) Valve.
49) Valve flange.
50) Storage strap.
51) Stiffened section.
52) Supplementary material.
54) Adhering strips.
56) Encasing jacket.

SUMMARY OF INVENTION

The invention is an improved self-inflating air pad. The air pad has resilient structure member 30 that expands airtight hollow body 32. Air is permitted to enter the airtight hollow body during inflating. Air is prevented from escaping the airtight hollow body during use.

What makes this invention unique are the geometries of the structure member and the airtight hollow body. A hollow resilient structure member is fitted to generate a relatively high volume configuration. This essentially means that airtight hollow body's volume decreases markedly when flattened. It also can mean that much more air is trapped with about the same amount of material.

The efficient geometries enable deformation to occur more smoothly. The air pads can be flattened without substantially changing their plan dimensions. They can be more load bearing without substantially changing their plan dimensions. The air pads can be more stable.

This geometry includes two categories of air pads, arch shaped ones and dome shaped ones. Arch shaped air pads have more distinct end sections. The end sections can stand at an angle. They may be stiffened to aid in inflating. These are other unique features.

DETAILED DESCRIPTION OF INVENTION

Figure 1:
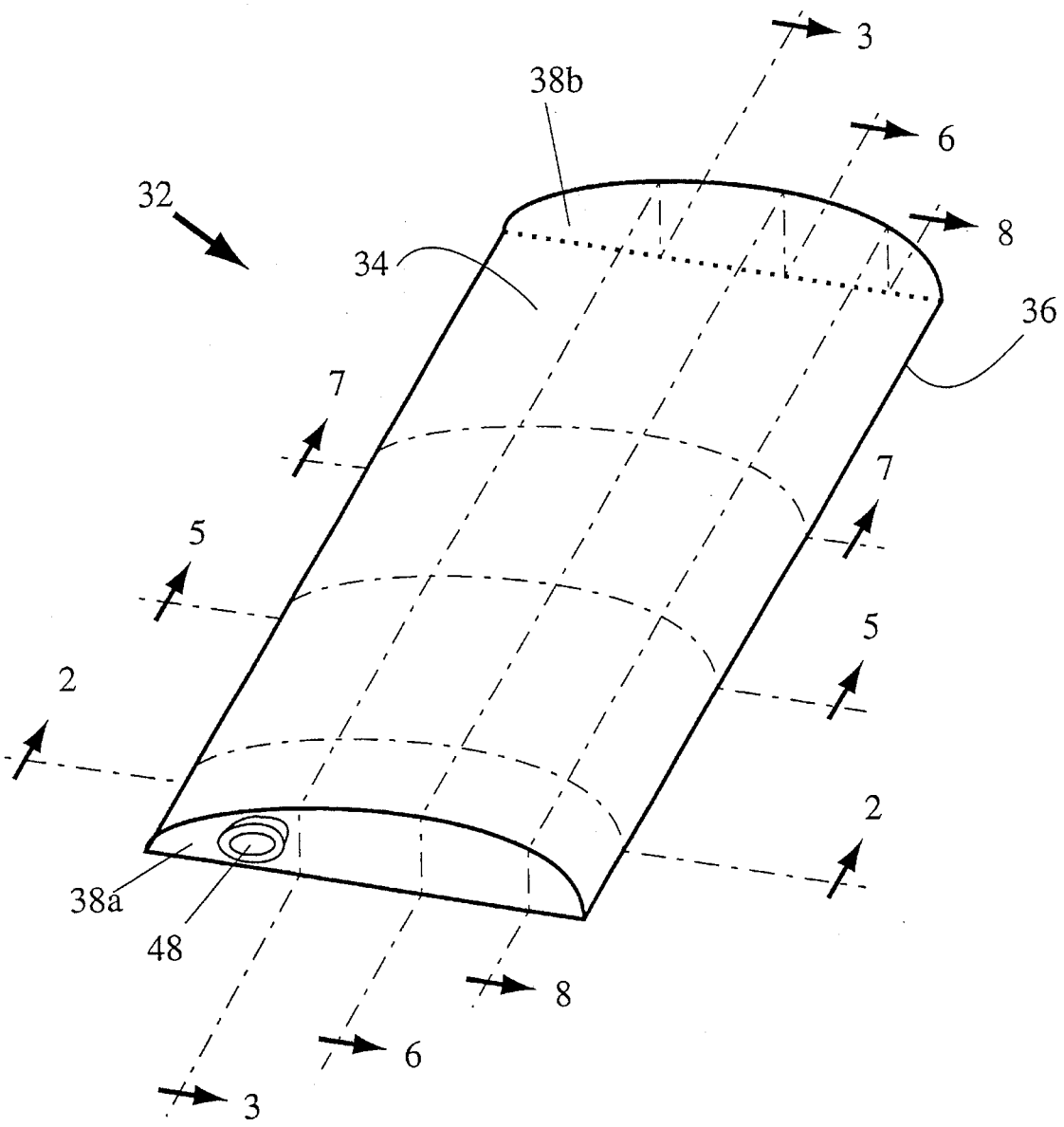
FIG. 1 is a perspective view of a geometrically efficient, arch shaped, self-inflating air pad in fully expanded, inflated configuration.

In accordance with the invention of a geometrically efficient self-inflating air pad, FIG. 1 is a perspective view of an arch shaped embodiment. FIG. 1 shows a self-inflating air pad in its expanded, inflated state. FIG. 1 illustrates an airtight hollow body 32 in the shape of a low arch. In an arch shaped embodiment, airtight hollow body 32 is comprised of a top section 34, a base section 36, and a pair of end sections 38*a* and 38*b*.

Shown in FIG. 1 is a valve 48. Valve 48 can be a push button or twist valve. Valve 48 also can be a check valve or one-way valve.

The name airtight hollow body 32 implies that it is substantially and adequately impermeable to air. It should be recorded that there may be some permissibly small leakage.

Base section 36 of airtight envelope 32 is the surface that meets the ground or other flooring. In FIG. 1 base section 36 is flat. Top section 34 is the surface that can come in contact with loads. The end sections 38*a* and 38*b* terminate the ends of arch shaped, airtight hollow body 32. The end sections are relatively upright or vertical.

Labeling these sections is helpful for describing the invention. It should be noted, though, that the boundaries between sections of airtight hollow body 32 can become blurred. Because the sections often are made of the same material, their borders may be blurred. The sections can even be totally interconnected, being made as one continuous unit. On the other hand, each section may be composed of multiple pieces of material. Also, as a load is applied end sections 38*a* and 38*b* can bend over to become part of top section 34 and part of base section 36. Nevertheless, these sections should be distinct and discernible enough for sufficiently clear identification.

At least top section 34 should comprise appropriately soft, flexible material. The base section 36 and the end sections 38*a* and 38*b* can be made of flexible material, rigid material, or some combination of rigid and flexible materials.

For the presented air pad to function properly, airtight hollow body 32 also must be adequately inelastic. This means that airtight hollow body 32 must not stretch excessively during use. Materials with high elongation percentages, such as polyurethane films, may be used, but they must be thick enough not to distend excessively during intended use.

Figure 2:
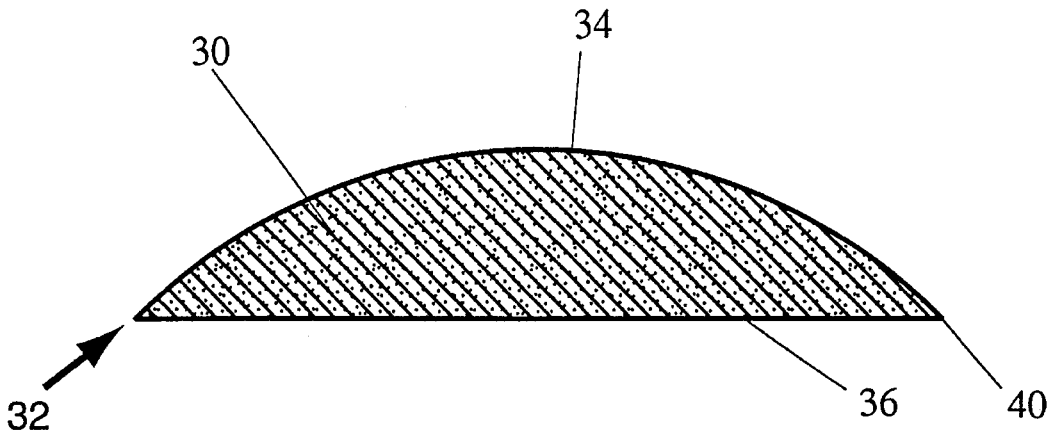
FIG. 2 is a transverse cross-section of an embodiment of the air pad in FIG. 1 along line 2—2 showing a geometrically efficient arching shape and a solid foam structure member.

FIG. 2 shows a vertical, transverse cross-section of an embodiment of the self-inflating air pad in FIG. 1 along the line 2—2. For the purposes of this invention, a vertical cross-section is one that intersects top section 34 and base section 36. When the text discusses vertical cross-sections, it is implied that these are fairly central. A central cross-section does not have to cut through the air pad's exact center. A central cross-section simply refers to one that is substantially representative of the air pad's main shape. All vertical cross-sections shown in the drawings are central.

FIG. 2 shows a foam, resilient structure member 30 inside airtight hollow body 32. In FIG. 2 foam structure member 30 is solid. In other words, foam structure member 30 substantially fills airtight hollow body 32. In embodiments where resilient structure member 30 is solid, low density foams are suitable. Various open-celled materials may be used including polyurethane foams. Though foam structure member 30 has open cells or holes, it is considered solid, not hollow, for the purposes of this invention.

FIG. 2 shows a geometrically efficient arching shape 40. An arching shape is simply a shape comprising a curve. A geometrically efficient shape is a shape with a high surface area relative to the area of a corresponding rectangle with equal perimeter and equal width, where width is defined as the shape's maximum dimension. A single arching shape is defined as a curve connected at its endpoints by a substantially straight line. In this drawing, geometrically efficient arching shape 40 is a single arching shape.

In FIG. 2 resilient structure member 30 is in an expanded position. This means that it can spring back to this approximate position. A major component feature of the present self-inflating pads, in their expanded state, is that vertical cross-sections of airtight hollow body 32 have geometrically efficient arching shapes 40. When airtight hollow body 32 has a series of vertical cross-sections that are geometrically efficient arching shapes 40, then it is said to form a geometrically efficient arching configuration. Since the air pad in FIG. 1 is in its expanded state, it is in a geometrically efficient arching configuration. Resilient structure member 30 is a yieldable, springy frame for airtight hollow body 32's geometrically efficient arching configuration.

Figure 3:
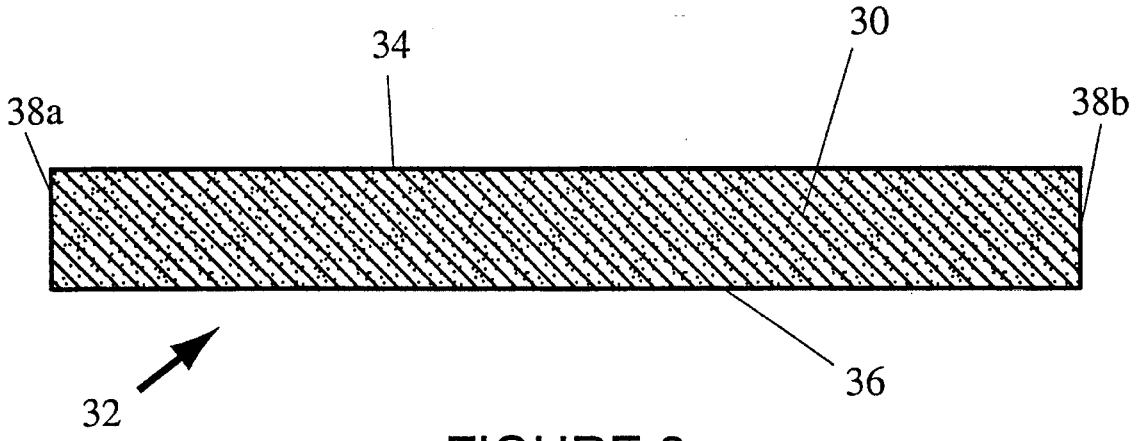
FIG. 3 is a longitudinal cross-section of an embodiment of the air pad in FIG. 1 along line 3—3 showing a solid foam structure member.

FIG. 3 shows a longitudinal, vertical cross-section of an embodiment of the air pad in FIG. 1 along the line 3—3. FIG. 3 again shows solid, foam structure member 30 inside airtight hollow body 32. The longitudinal cross-section of FIG. 3 intersects top section 34, base section 36, and end sections 38*a* and 38*b*.

The longitudinal, vertical cross-section in FIG. 3 does not have a geometrically efficient arching shape 40. This is generally true in arch shaped embodiments of the invention.

Figure 4:
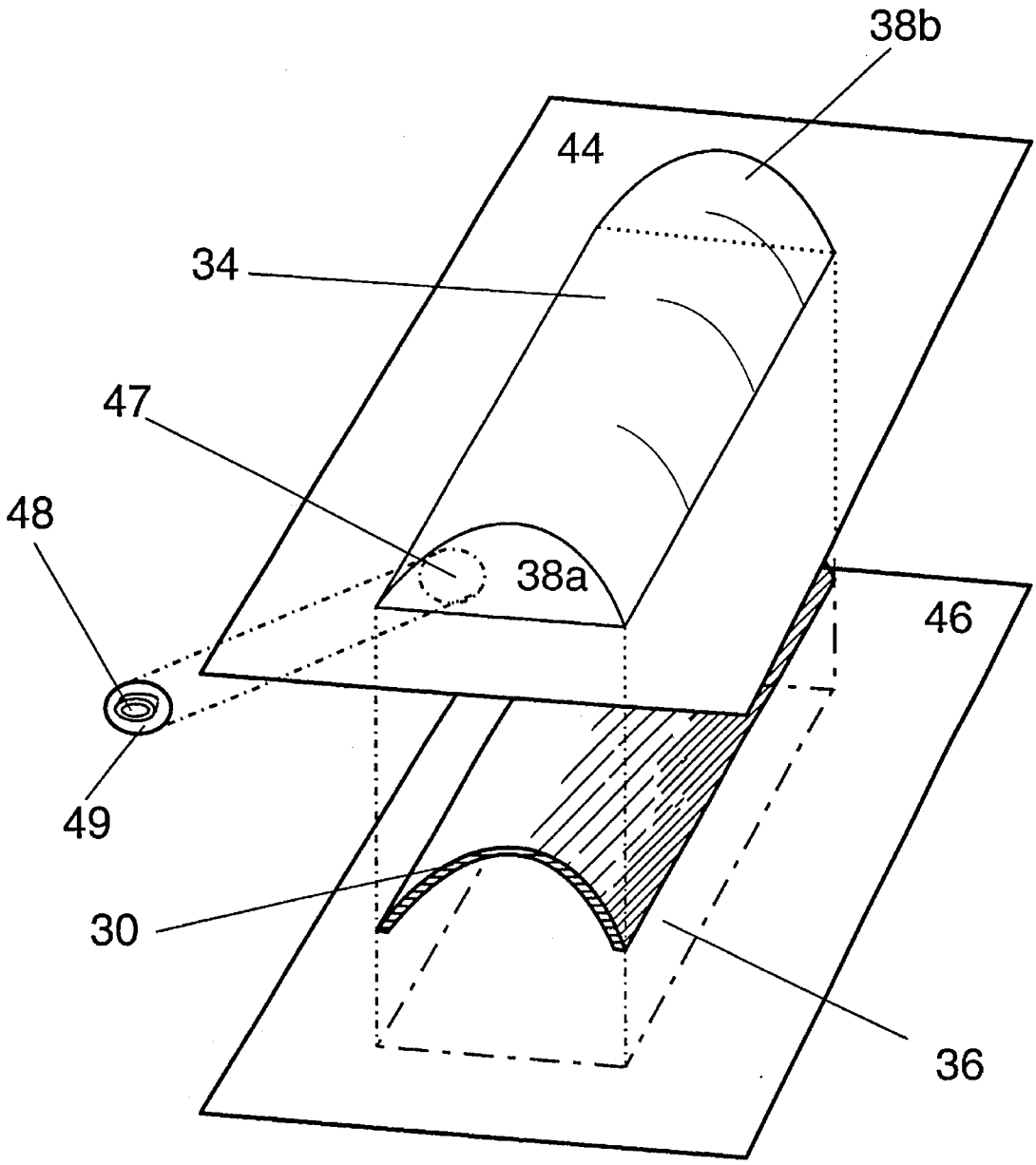
FIG. 4 is an exploded view of an arch shaped embodiment of the geometrically efficient self-inflating air pad.

FIG. 4 is an exploded view of an arch shaped embodiment of the geometrically efficient self-inflating air pad. In FIG. 4, resilient structure member 30 does not substantially fill the airtight hollow body and thus is hollow. This means that, in its expanded position, the structure member has a substantial concavity and does not substantially fill the airtight hollow body.

FIG. 4 illustrates how the disclosed self-inflating air pad can be made. Top section 34, and end sections 38*a* and 38*b* can be thermoformed as one piece to form a cavity with the desired shape, in this case an arch. In the process, a top section flange 44 could be left around the base of the top section and end sections.

End section 38*a* has a hollow body opening 47. Flow of fluid through this opening is regulated by valve 48. Valve 48 has valve flange 49 that is sealed around hollow body opening 47. This sealing can be done on the inside or outside. In some embodiments, though, valve 48 can be an integrated piece.

Resilient structure member 30 can be molded to mimic substantially the shape of the cavity formed by top section 34, and end sections 38*a* and 38*b*. Next resilient structure member 30 is inserted into this cavity. Then base section 36 is cut with a base section flange 46. Base section 36 is again flat. Top section flange 44 and base section flange 46 are finally sealed to form the airtight hollow body around resilient structure member 30.

Top section 34 and base section 36 are thereby connected in airtight relation along a border. Radio frequency sealing, heat sealing, or other sealing method can be used to connect the various parts. The sealing method will depend on the types of material used.

The airtight chamber is formed to have a geometrically efficient arching configuration. As a result, the airtight hollow body is substantially taut when in this configuration. This means that airtight hollow body 32 forms the arching configuration without any substantial wrinkles, folds, or slack material. In the preferred embodiment, airtight hollow body 32 is taut in its geometrically efficient arching configuration.

Figure 5:
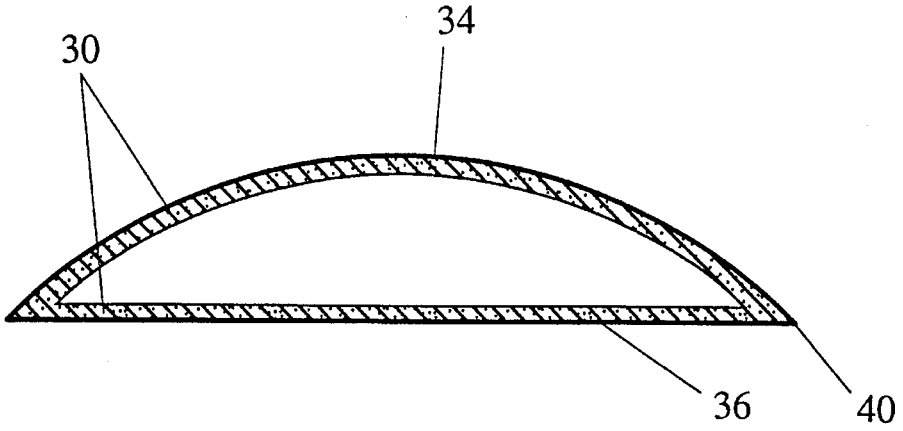
FIG. 5 is a transverse cross-section of an embodiment of the air pad in FIG. 1 along the line 5—5 showing a hollow, resilient structure member and a geometrically efficient arching shape.

FIG. 5 shows a vertical, transverse cross-section of an embodiment of the air pad in FIG. 1 along the line 5—5. FIG. 5 represents a different embodiment from that shown in FIG. 2. In this embodiment resilient structure member 30 is not solid as in FIG. 2, but has a substantial hollow 31. This is a substantially homogeneous, air-tillable cavity inside airtight hollow body 32. Thus, resilient structure member 30 substantially surrounds hollow 31; and thus, resilient structure member 30 is said to be hollow. In FIG. 5 resilient structure member 30 contacts and lines the inside surface of the airtight chamber.

A wider range of materials can be used in embodiments with hollow structure members. Higher density flexible foams can be used. Even closed cell materials such as rubbers can be used. The requirement is that the materials be appropriately resilient and flexible.

Because FIG. 5 shows geometrically efficient arching slope 40, the airtight chamber is in a geometrically efficient arching configuration. Recall that a geometrically efficient arching configuration is a form of the airtight chamber where vertical cross-sections have geometrically efficient arching shapes 40.

In FIG. 5, hollow structure member 30 is fitted to the geometrically efficient arching configuration of airtight hollow body 32. When resilient structure member 30 is hollow, this means that it substantially lines the curved portion of the geometrically efficient arching configuration. Hollow, resilient structure member 30 also is in an expanded position. This signifies that the structure member will spring back to this approximate position.

Figure 6:
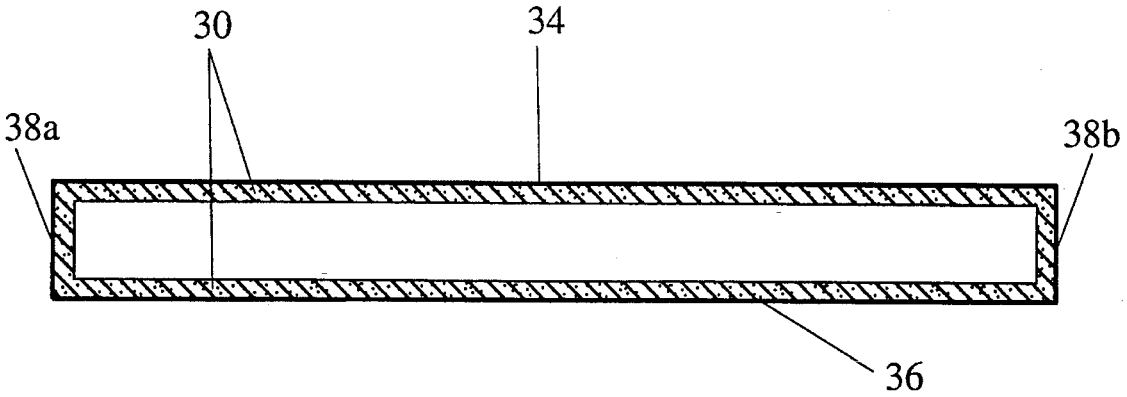
FIG. 6 is a longitudinal cross-section of an embodiment of the air pad in FIG. 1 along line 6—6 showing a hollow, resilient structure member that lines the inner walls of the airtight hollow body.

FIG. 6 is a longitudinal cross-section of an embodiment of the air pad in FIG. 1 along the line 6—6. FIG. 6 is the embodiment in FIG. 5 from a longitudinal cross-section viewpoint. FIG. 6 shows hollow structure member 30 lining the inside surface of the airtight chamber.

Resilient structure member 30 may consist of separate pieces of material. For example, the embodiment in FIG. 1, as completed by FIG. 5 and FIG. 6, could have two sections of foam. One piece of foam lines top section 34. A second piece of foam lines base section 36, and end sections 38*a* and 38*b*. In a further decomposition, separate pieces of foam could line the end sections.

Figure 7:
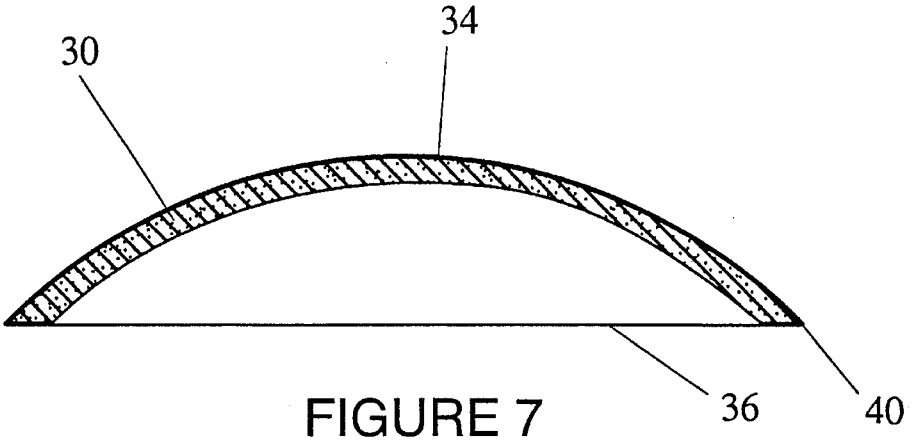
FIG. 7 is a cross-section of an embodiment of the air pad in FIG. 1 along line 7—7 showing a resilient structure member lining just the airtight hollow body's curved portion.

FIG. 7 shows a vertical, transverse cross-section of an embodiment of the air pad in FIG. 1 along the line 7—7. FIG. 7 represents only a slightly different embodiment from that shown in FIG. 5. As in FIG. 5, the internal structure member 30 is has hollow 31. In FIG. 7 resilient structure member 30 only lines the inside surface of top section 34. In FIG. 7 hollow structure member 30 does not line the base section 36, as in FIG. 5. In FIG. 7, resilient structure member 30 still substantially surrounds hollow 31, although to a lesser extent than in FIG. 5. FIG. 7 shows the embodiment of FIG. 4 in vertical cross-section. FIG. 7 shows the recurring theme of geometrically efficient arching shape 40.

Figure 8:
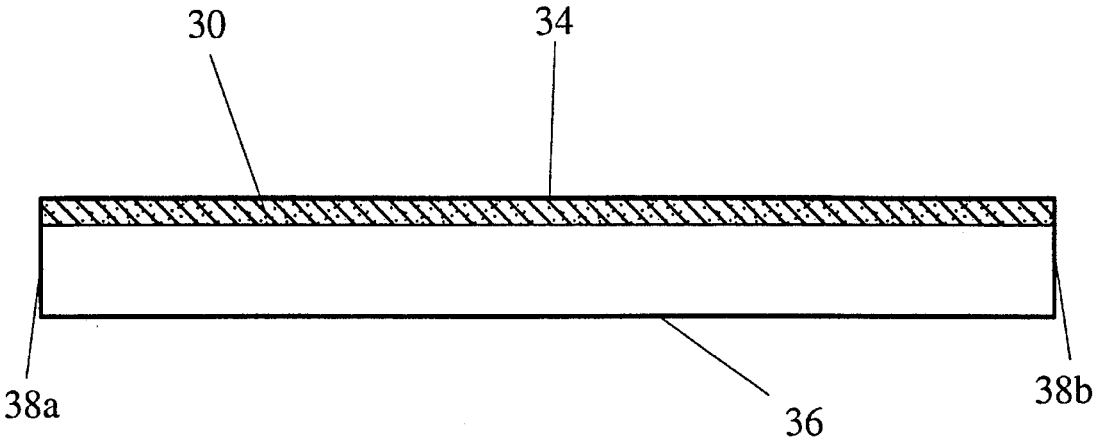
FIG. 8 is a cross-section of an embodiment of the air pad in FIG. 1 along line 8—8 showing a hollow, resilient structure that lines the inner walls of the top section.

FIG. 8 is a longitudinal cross-section of an embodiment of the air pad in FIG. 1 along the line 8—8. FIG. 8 is the embodiment in FIG. 7 from a longitudinal cross-section viewpoint. FIG. 7 shows resilient structure member 30 lining the inside surface of top section 34. Hollow structure member 30 does not line base section 36, nor end sections 38*a* and 38*b*. Because hollow structure member 30 is open at the ends, it abuts end sections 38*a* and 38*b* only along where they connect to top section 34.

In the presently preferred embodiment, resilient structure member 30 attaches to airtight hollow body 32. This adhesion can occur in various places. For example, structure member 30 could be glued to the airtight hollow body wherever they touch in the expanded, inflated configuration. Another recommended embodiment is where resilient structure member 30 is only adhered to the base section. This would allow the hollow body to displace along the surface of structure member 30, and thus to deform more freely. Sometimes, it may be preferable not to adhere resilient structure member 30 to airtight hollow body 32.

Also, note that the wall thickness of hollow structure members 30 in the drawings is shown for illustration purposes only. The thickness of these walls can vary. The wall thickness of hollow structure members 30 will depend on the materials, the size of the air pad, and the application.

Figure 9:
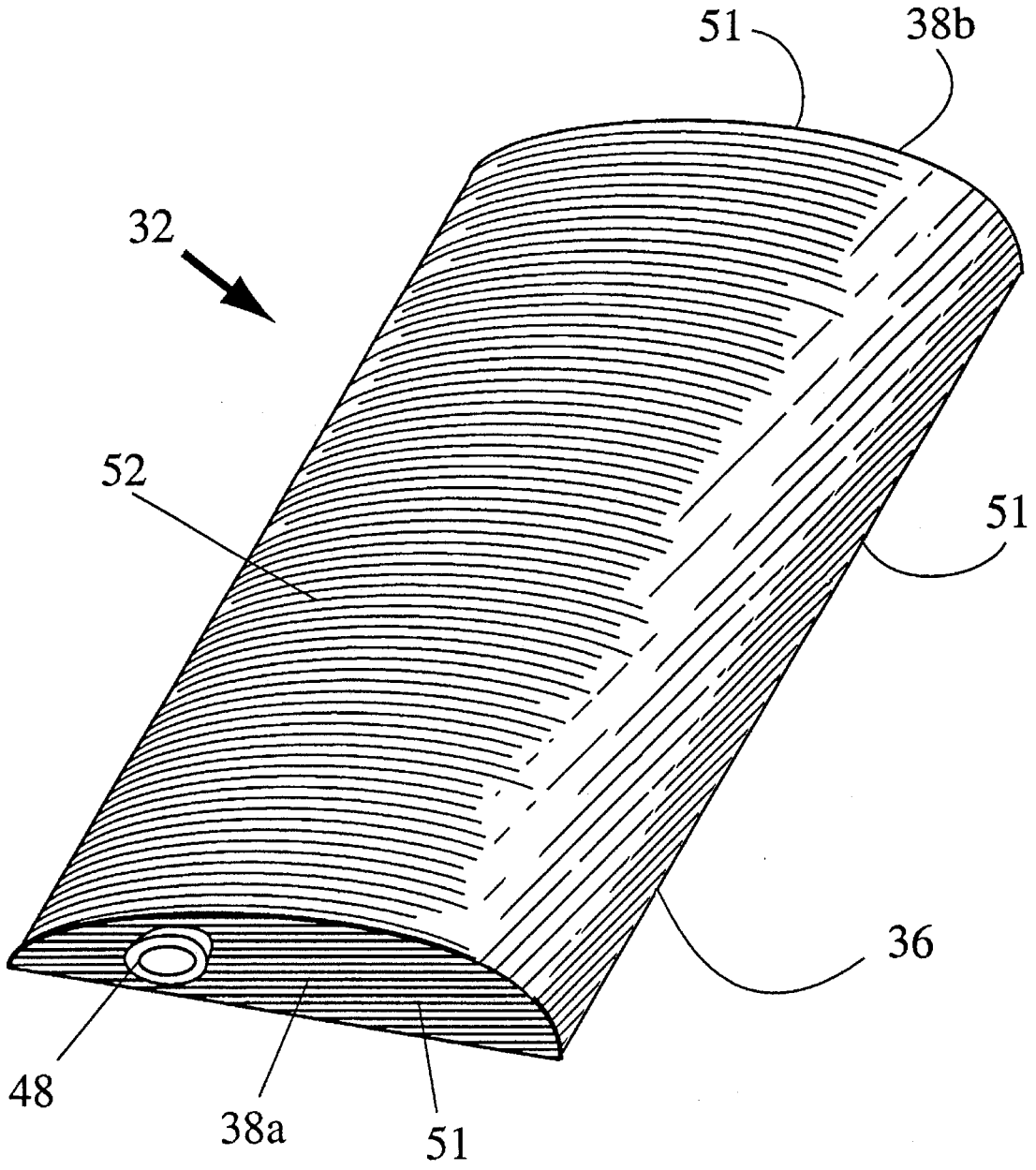
FIG. 9 is a perspective view of an arch shaped embodiment combined with stiffened end sections and supplementary material over its top section.

FIG. 9 is a perspective view of an arch shaped embodiment of the presented air pad with added features. Top section 34 is covered with a supplementary material 52. Supplementary material may be connected to airtight hollow body 32 or may envelop the same. Supplementary material also could be added to the inside walls of airtight hollow body 32. In FIG. 9, end sections 38*a* and 38*b* are stiffened sections 51. The primary method for stiffening sections of airtight hollow body 32 is the inclusion of rigid materials. However, it is possible to stiffen a section of flexible material by a means to make the particular section taut.

In FIG. 9, the air pad again is shown in its expanded, inflated state and an arching configuration is evident. Again the air pad has a flat base. FIG. 9 shows that base section 36 also can be a stiffened section 51. This can be achieved by adding a plurality of flat rigid pieces of material to base section 36.

Figure 10:
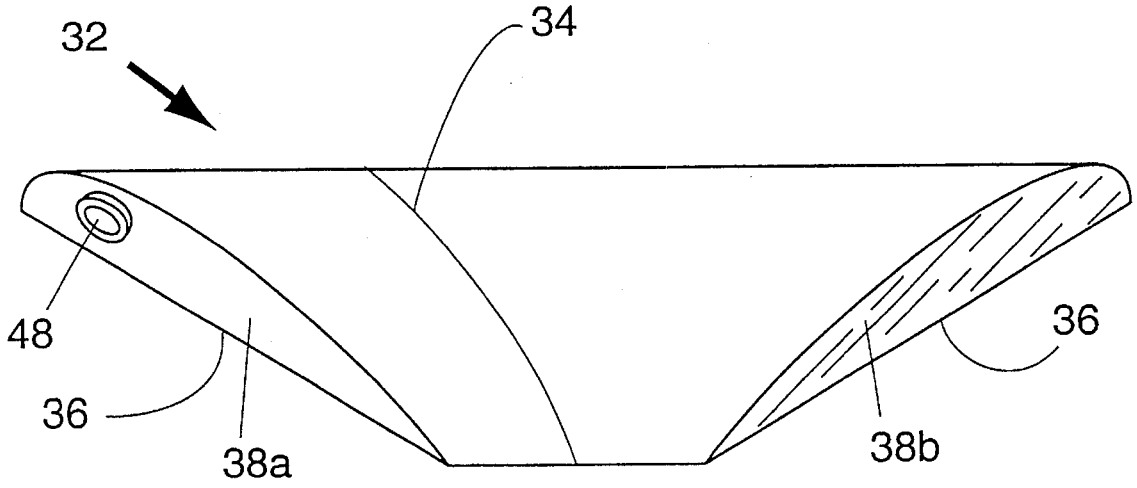
FIG. 10 is a perspective view of an arch shaped embodiment where end sections stand at an angle.

FIG. 10 is a perspective view of an arched shaped embodiment with end sections 38 standing at a marked angle to each other. Angled end sections 38 are shown to be substantially symmetrical. This geometry means that the air pad's breadth directly from left to right increases substantially from front to back. The air pad is shown in its expanded, inflated state. Again, an airtight hollow body 32 comprises a top section 34, a base section 36, and end sections 38*a* and 38*b*. The valve 48 is conveniently placed on one of these end sections. The drawing repeats the geometrically efficient arching configuration theme.

The shape portrayed in FIG. 10 is an example of arch shaped embodiments where the end sections lie at an angle. This angle might be wider in a bicycle seat application. The angle probably would be slighter in self-inflating cushions for use as insoles.

Although these shapes may appear difficult to manufacture, they are not. The arch shapes described can be molded from sections of a large pipe and flat sheets of metal. To obtain the shape in FIG. 10, the transverse cuts in the pipe are simply made at an angle.

Figure 11:
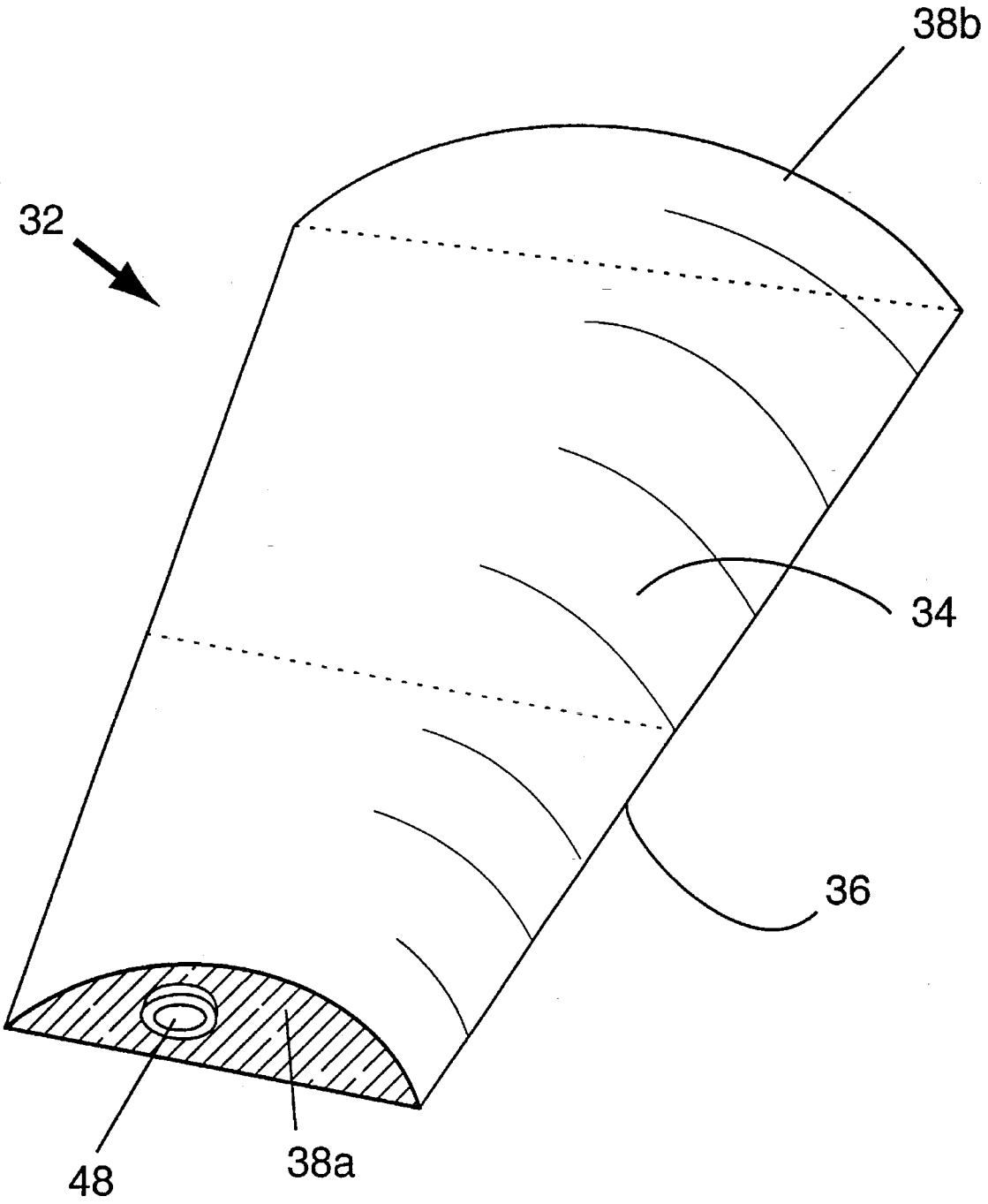
FIG. 11 is a perspective view of an arch shaped embodiment where vertical, transverse cross-sections change in size along the longitudinal dimension.

FIG. 11 is a perspective view of another arch shaped embodiment. Again, the geometrically efficient self-inflating air pad in FIG. 11 is shown in its expanded, inflated state. The geometrically efficient arching configuration augments from end section 38*a* to end section 38*b*. Transverse, vertical cross-sections increase in size from end section 38*a* to end section 38*b*. In a similar fashion, transverse cross-sections also could change in shape from one end section to another.

Figure 12:
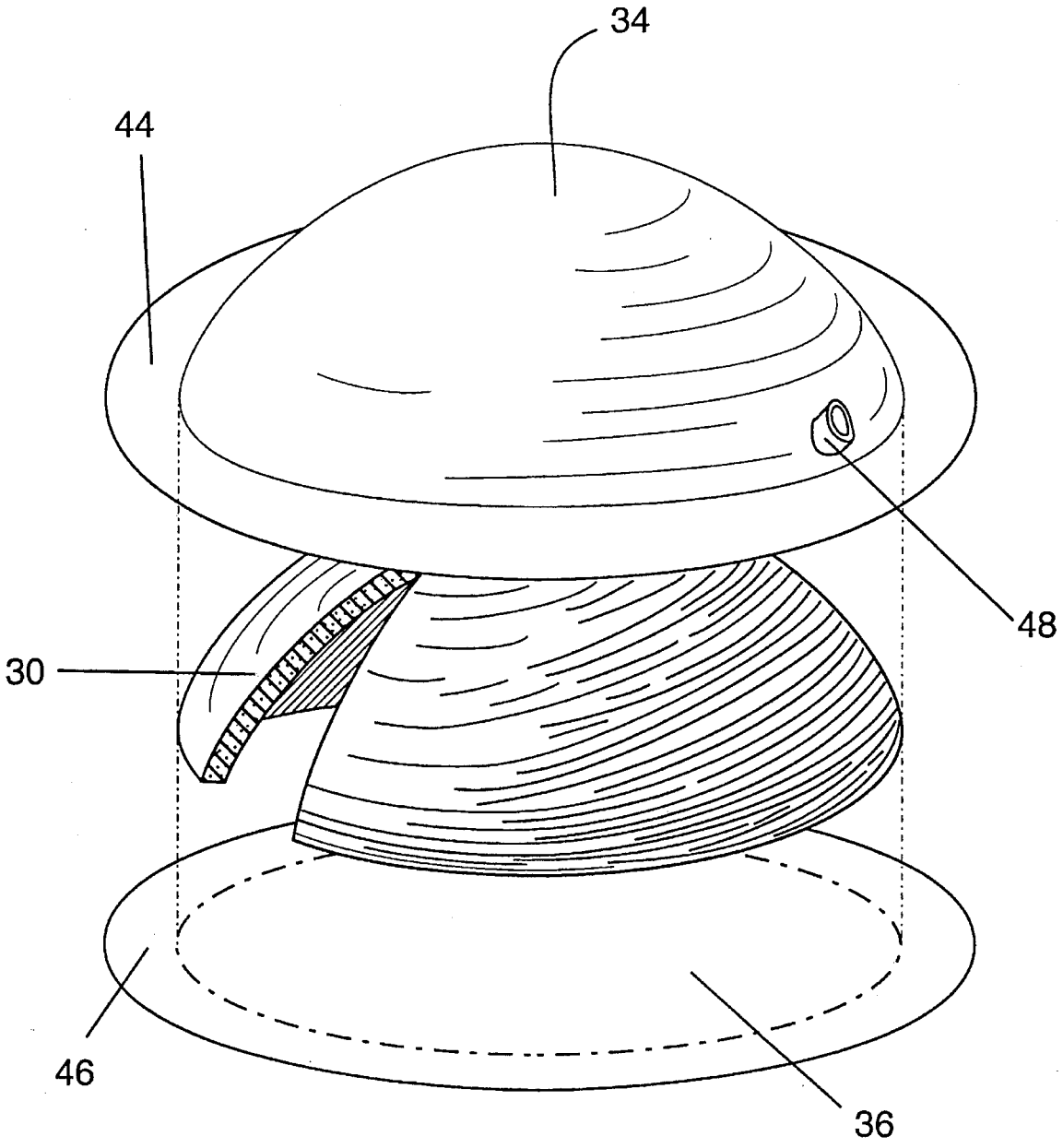
FIG. 12 is an exploded, cutaway view of a domed shaped embodiment of the invention.

FIG. 12 is an exploded view of a dome shaped embodiment of the geometrically efficient self-inflating air pad. FIG. 12 portrays top section 34 and base section 36. In a dome shaped embodiment, the airtight hollow body is comprised of these two sections. In a dome shaped embodiment there are no distinct end sections. The lack of distinct end sections differentiates dome shaped embodiments from arch shaped embodiments.

A dome shaped resilient structure member 30 is shown in FIG. 12. The structure member is again to be internal to the airtight hollow body. Resilient structure member 30 is hollow, although it could be solid. Resilient structure member 30 is fitted to the geometrically efficient arching configuration of the airtight chamber.

Top section 34 has a top section flange 44. Similarly, base section 36 has a base section flange 46. These flanges can be used to seal resilient structure member 30 inside the airtight hollow body. Base section 36 is again flat. The valve 48 can be incorporated into the airtight hollow body at some convenient stage.

Figure 13:
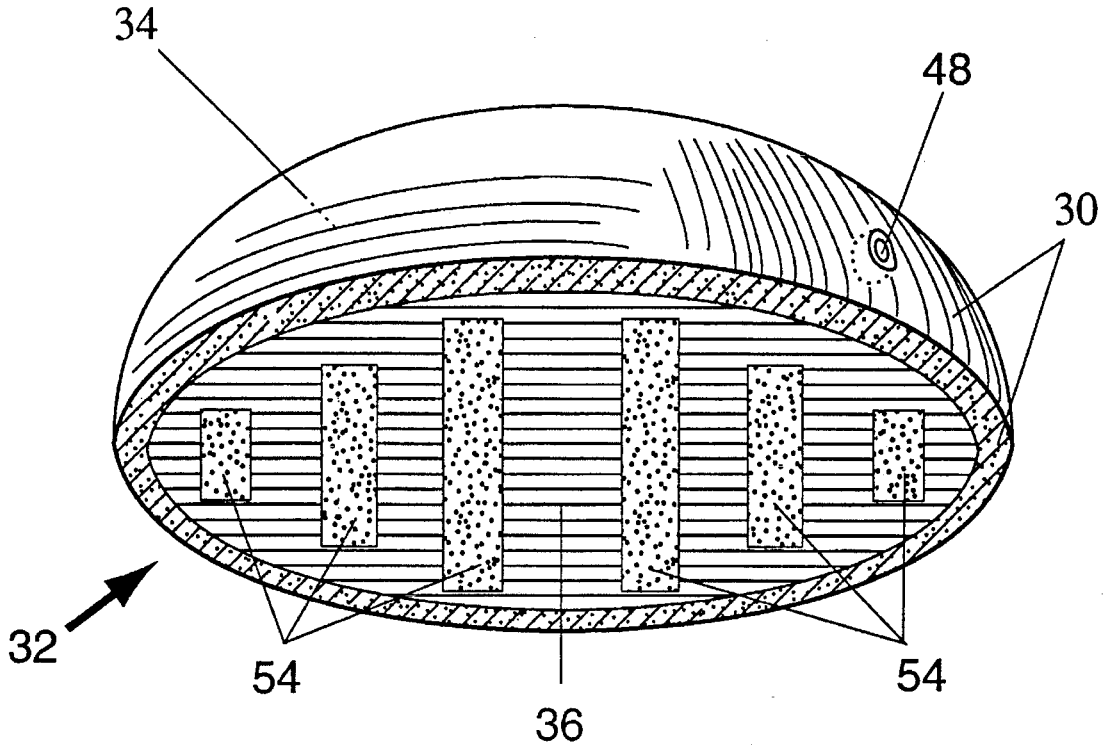
FIG. 13 is a perspective view of a domed shaped embodiment in expanded configuration, showing adhering means, and an external, resilient structure member.

FIG. 13 is a perspective view of a dome shaped embodiment of the geometrically efficient self-inflating air pad. The air pad is in its expanded, inflated state. A geometrically efficient arching configuration is shown. In this drawing the viewer is looking at the air pad from an inferior position. As a result, the base section is shown as the largest face.

Attached to base section 36 are adhering strips 54. Examples of adhering strips 54 are hook and loop fasteners and sticky back tape. Such adhering means can be used to affix the self-inflating air pads wherever appropriate.

The top of the air pad in FIG. 13 is the resilient structure member. In this version of the air pad invention, resilient structure member 30 is external to airtight hollow body 32. In FIG. 13 structure member 30 cups top section 34, which is hidden. Thus the foam structure member is again fitted to the geometrically efficient arching configuration of airtight hollow body 32.

Resilient structure member 30 clearly must be hollow when it is external to airtight hollow body 32. When resilient structure member 30 is external to airtight hollow body 32, then these two, also must be adhered. Valve 48 is shown piercing the external structure member.

Figure 14:
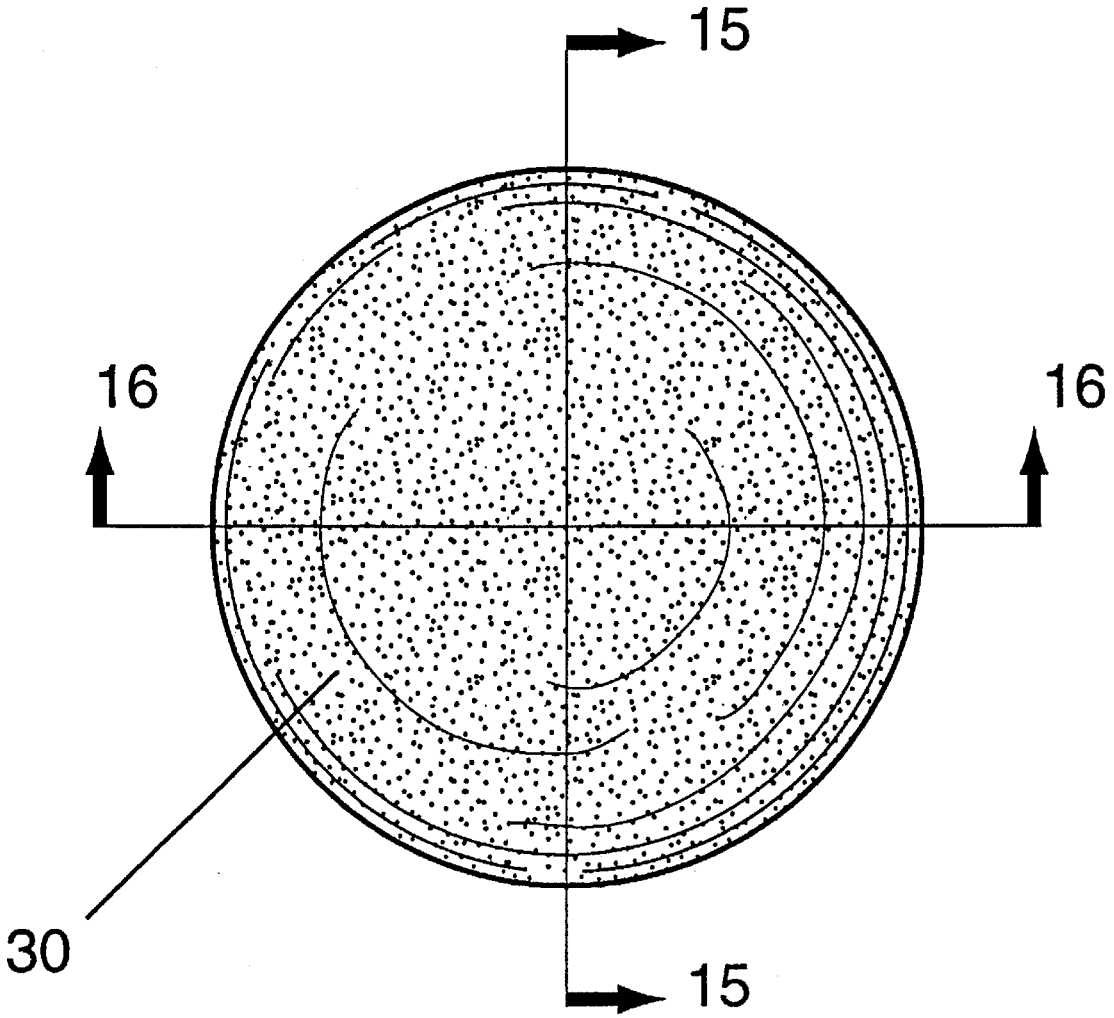
FIG. 14 is a top view of a dome shaped embodiment.

FIG. 14 is a top view of a dome shaped embodiment. The shading indicates that resilient structure member 30 covers the top section of the airtight hollow body.

Figure 15:
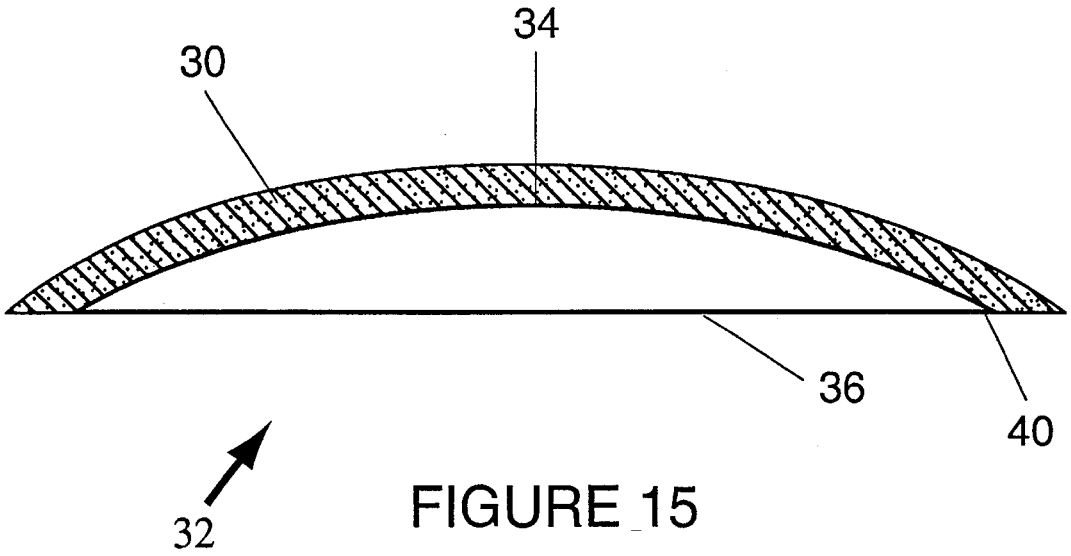
FIG. 15 is a cross-section of an embodiment of the air pad in FIG. 14 along line 15—15 showing a geometrically efficient arching shape and an external, resilient structure member.

FIG. 15 is a vertical cross-section of an embodiment of the air pad in FIG. 14 along the line 15—15. This diagram shows resilient structure member 30 outside airtight hollow body 32. In FIG. 15 the external structure member 30 lines the outside of top section 34. Base section 36 is exposed. This vertical cross-section of airtight hollow body 32 in its expanded state has geometrically efficient arching shape 40. All embodiments of the air pad invention will have significant cross-sections with this feature. This is true for both arch and dome shaped embodiments.

Figure 16:
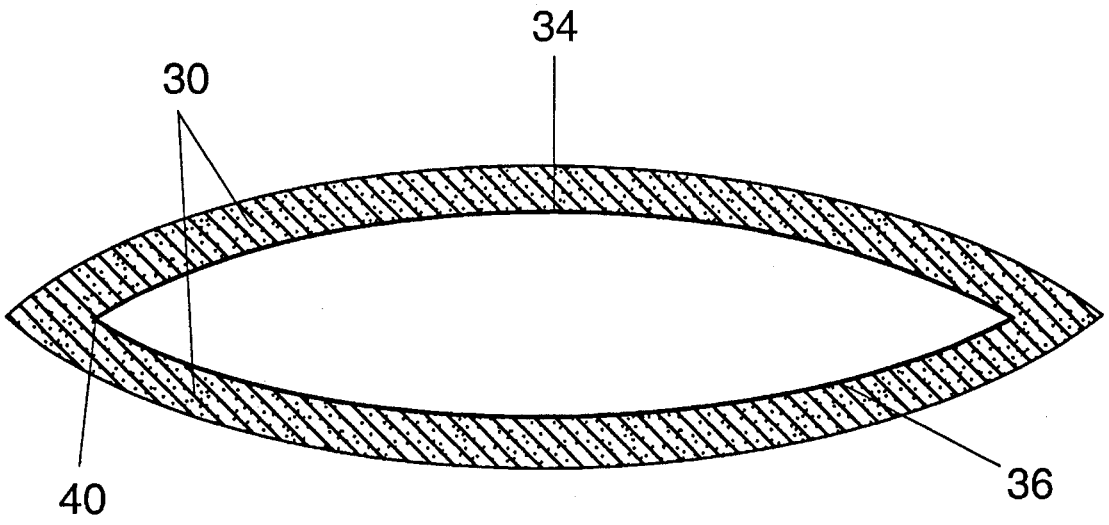
FIG. 16 is a cross-section of an embodiment of the air pad in FIG. 14 along line 16—16 showing a double arching shape.

FIG. 16 is a vertical cross-section of the air pad in FIG. 14 along the line 16—16. This diagram defines a different embodiment than FIG. 15. Like FIG. 15, FIG. 16 shows resilient structure member 30 outside airtight hollow body 32. However, in FIG. 16 external structure member 30 lines both top section 34 and base section 36.

Another modification is present in FIG. 16. Geometrically efficient arching shape 40 is comprised of two curves. Base section 36 is not flat. Both top section 34 and base section 36 have a convex, curved are. This represents a double arching configuration. A double arching shape does not have a substantially straight line connecting the end points of a curved line.

Notice that in dome shaped embodiments virtually all vertical cross-sections form geometrically efficient arching shapes 40. Line 15—15 and line 16—16 are perpendicular to each other and their resulting cross-sections both comprise relatively low, curved arcs.

Figure 17:
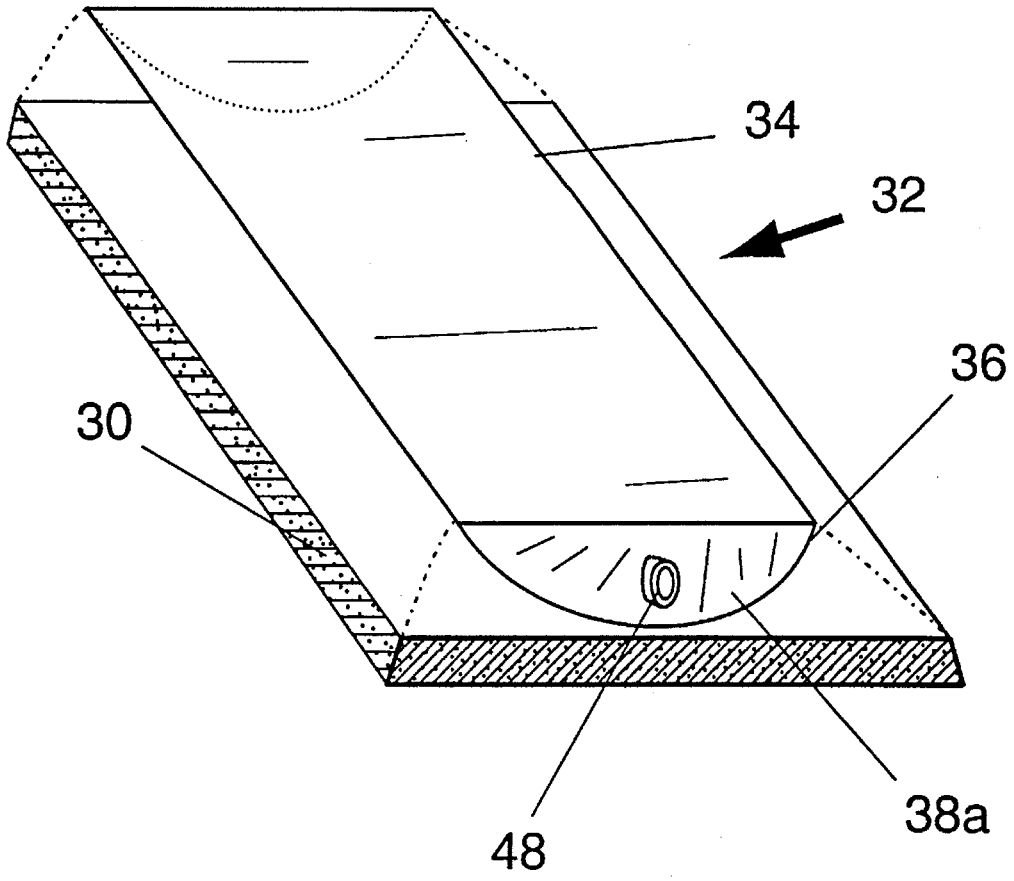
FIG. 17 is an exploded view of an arched shaped embodiment where a curved, external structure member is made from a flat section of resilient material.

FIG. 17 is an exploded view of an arch shaped embodiment of the self-inflating air pad where resilient structure member 30 is external. FIG. 17 demonstrates that resilient structure member 30 can readily line the exterior of an arch shaped embodiment. FIG. 17 reminds how external structure members must be hollow, and the meaning thereof.

The exploded view in FIG. 17 exhibits another important possible characteristic of resilient structure member 30. Although resilient structure member 30 can begin as a curved piece, it also can begin as a flat piece. This flat piece can then be curved around airtight hollow body 32. This curved placement is conveyed by the curved projection lines in FIG. 17. In the curved position, resilient structure member 30 and airtight hollow body 32 of FIG. 17 are to be connected. This is roughly the expanded position of structure member 30.

Again, there are many choices for the material of resilient structure member 30. Open celled foams are presently preferred. Many polyurethane foams are suitable. The material should be very resilient, a common characteristic of many foams. In hollow structure member embodiments, the thickness and densities of foams can be increased to provide more resiliency and expanding force.

Being able to make structure member 30 out of a flat piece of resilient material is useful because materials can readily be purchased in this form. Therefore, an advantage of hollow, resilient structure members 30 is that flat pieces of foam and the like can be used.

In FIG. 17, resilient structure member 30 is designed to only line top section 34. Observe that the foam structure member 30 is tapered inward along its longitudinal edges so that these edges will lay flat when curved downward. It is clear, however, that resilient structure member 30 could extend around base section 36. Again, resilient structure member 30 can be composed of multiple sections of material. Separate foam pieces also could line end sections **38*a* and 38*b***.

Resilient structure member 30 is still considered fitted in FIG. 17. It is hollow, and it lines a portion of the geometrically efficient arching configuration formed by airtight hollow body 32.

The external structure member enables the airtight hollow body to be formed as a single chamber. Top section 34, base section 36, and end sections **38*a* and 38*b* could all be made as one integral part. This could be accomplished by blow molding. Integral airtight hollow body 32 eliminates the need for the top and base section flanges. In such embodiments, top section 34 and base section 36** are completely interconnected along a somewhat artificially designated border.

Figure 18:
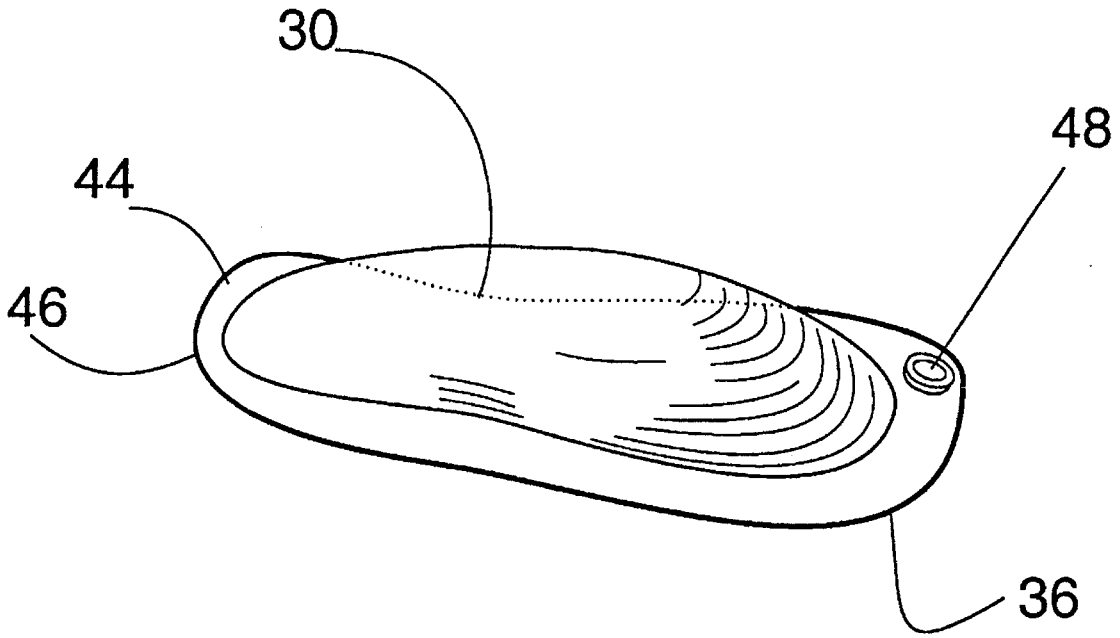
FIG. 18 is a perspective view of an elongated dome shaped embodiment, shaped as an insole.

FIG. 18 is a perspective view of an elongated, dome shaped embodiment of the geometrically efficient self-inflating air pad. Until now the dome shaped embodiments have been circular in plan. In FIG. 18 this is not so. However, all vertical cross-sections still form curved arcs. The embodiment is shaped as the sole of a foot. Note that when saying all cross-sections, text implies all meaningful vertical cross-sections. Obviously, in FIG. 18 a vertical cross-section could be taken near the flanges where there would be no discernible curved are. Also, it is assumed that the airtight hollow body is in its expanded, inflated state.

Since there are flanges in FIG. 18, it can be assumed that there is an internal resilient structure member 30. Arch shaped embodiments also can have both an internal structure member and an external structure member. The air pad in FIG. 18 is classified as a dome since there are no distinct end sections. It should be recorded, however, that shapes that are hybrids between arches and domes are also possible. For example, a support may have only one distinct end section. Or a dome shaped embodiment might be truncated to give it a plurality of end sections.

Figure 19:
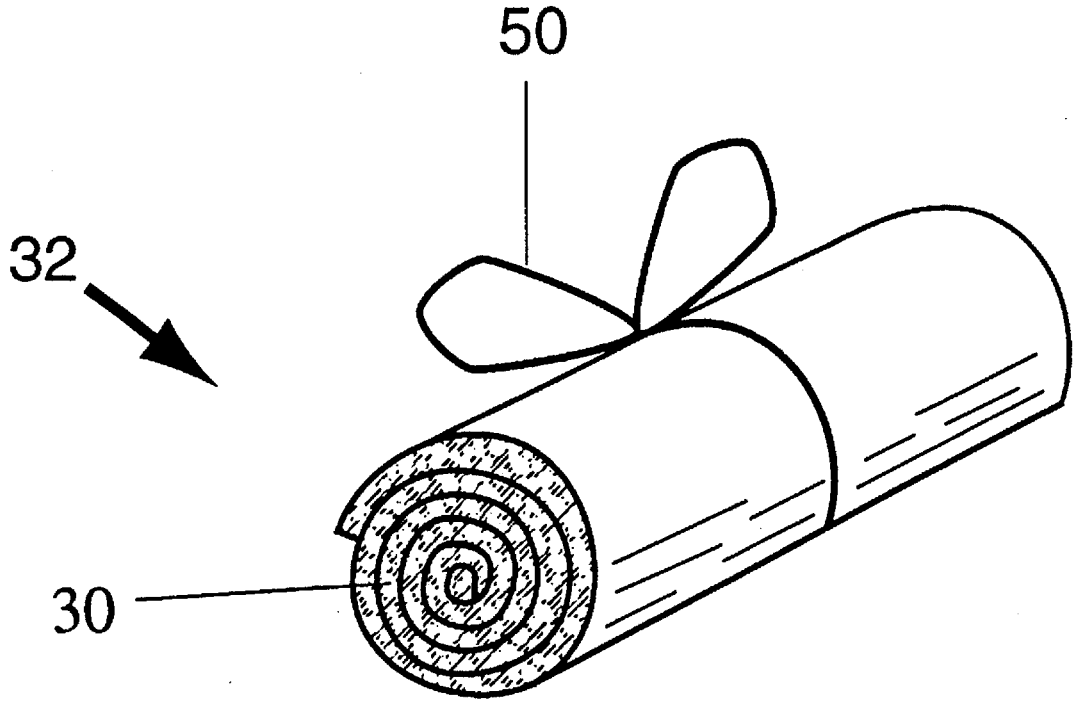
FIG. 19 is an arch shaped embodiment in collapsed, rolled configuration, showing the configuration secured by a strap.

FIG. 19 shows an example of the invention rolled for convenient storage or portage. Since resilient structure member 30 is visible, it is external. The air pad is in a collapsed, deflated state.

Figure 20:
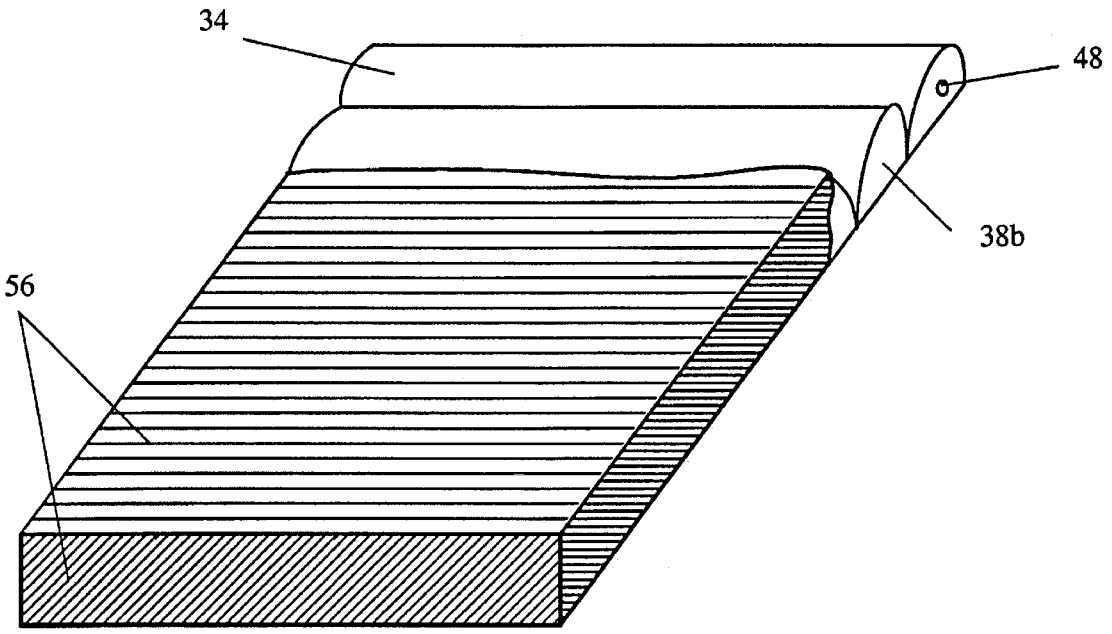
FIG. 20 is a perspective view of a multi-chamber embodiment, covered by a jacket.

FIG. 20 is a perspective view of a multi-unit application. FIG. 20 shows multiple arch shaped air pads. The individual air pads are juxtaposed along their longitudinal edges. A taut encasing jacket 56 is shown coveting the individual air pads. A portion of encasing jacket 56 is cut away to expose the individual air pads. Encasing means, such as jackets or straps, can be made of nylon or other appropriately inelastic materials.

Figure 21:
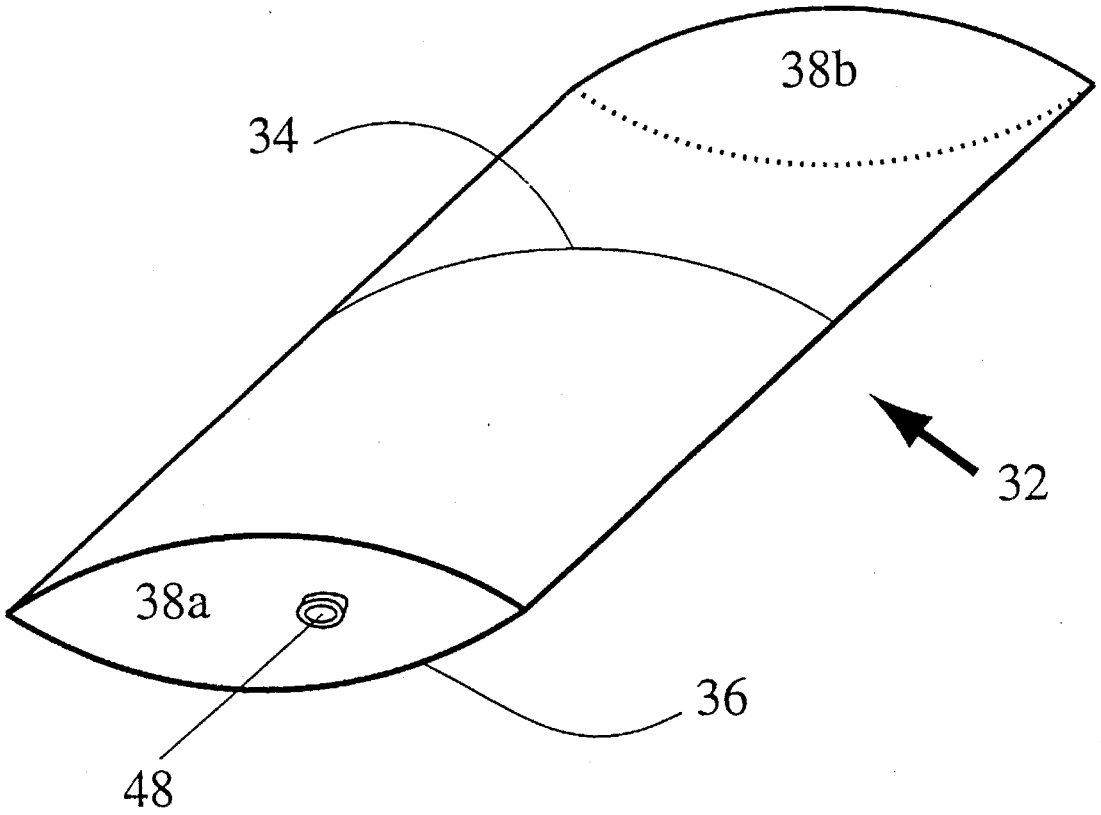
FIG. 21 is a perspective view of an arch shaped embodiment with a base section that is not flat.

FIG. 21 is a perspective view of an arch shaped embodiment. This is an example where the cross-sections of both top section 34 and base section 36 form curved arcs. In FIG. 21 the are of top section 34 and base section 36 are substantially identical. However, this is not a requirement. This type of double arching design may particularly call for stiffened end sections. This and other functionality is explained next.

OPERATION OF INVENTION

Overview

Below is an overview of the operation of the invention. During inflating, resilient structure member 30 forms an arching shape. Resilient structure member 30 yieldably frames airtight hollow body 32. Therefore, airtight hollow body 32 also takes on this general shape.

Also during inflating, valve 48 allows air to enter airtight hollow body 32 substantially freely. Consequently, air flows into airtight hollow body 32 until the air pressure inside the chamber substantially equals the atmospheric pressure outside the chamber.

During use, the contained air is sealed inside airtight hollow body 32. Valve 48 prevents air from escaping through hollow body opening 47.

When a load is supplied to the air pad, the volume inside the chamber decreases. This in turn causes air pressure inside the chamber to increase. Higher air pressure means greater weight supporting capacity per unit surface area. In this way the geometrically efficient self-inflating air pad supports and achieves its purpose.

Resilient Structure Member 30

Resilient structure member 30 naturally springs to its expanded position. This causes airtight hollow body 32 to enter a relatively high volume, geometrically efficient arching configuration.

In FIG. 4, resilient structure member 30 has sufficient force to push out the formed cavity in flexible, top section 34. Similarly, in FIG. 12 resilient structure member 30 pushes out its dome shape in top section 34. In FIG. 17, resilient structure member 30 pulls airtight hollow body 32 into a low, arching configuration.

When structure member 30 is solid, its tendency to form its shape in flexible, airtight hollow body 32 is strong. However, there are some potential problems with solid structure members. First, a solid structure member can inhibit inflating fluid from entering airtight hollow body 32. One reason for this is that the structure member itself takes up more space leaving less volume for the inflating fluid. Another reason is that inflating fluids may not circulate completely freely through the open celled material. Second, since the presented air pads have curved surfaces, a solid foam structure member can provide uneven support. This problem arises if a curved foam structure member maintains its curved shape when the air pad is used. This could cause the supported item to roll off the air pad. Third, a solid, resilient structure member makes the air pad less portable and stowable. With a solid structure member, the high volume, geometrically efficient shapes, which are a boon for inflating, can detract from collapsibility.

These problems can be solved by making resilient structure member 30 hollow. Inflating fluid will circulate freely in the void of a hollow structure member. Hollow, resilient structure member 30 obviously takes up less volume; there is less material inside the chamber. Hollow, resilient structure members can collapse more readily. Another advantage of a hollow structure member is that there is a more even amount of foam.

The question about hollow, resilient structure member 30 is whether it will have a tendency to return to its expanded state. The answer is yes. Hollow, foam structure members tend to move airtight hollow bodies into their geometrically efficient arching configurations. It is surprising how resiliently various hollow structure members can expand airtight hollow body 32.

It is also unobvious that hollow structure member 30 will give airtight hollow body 32 its near optimal volume. This is true even if resilient structure member 30 has no curved structure of its own. For example, the flat piece of foam in FIG. 17 when curved into an arch can consistently transmit the desired, substantially optimal, high volume, arching configuration.

The foam structure member's primary role is to expand and inflate airtight hollow body 32. The self-inflating pad thus becomes an air cushion. However, foam structure member 30 can provide its own cushioning. This foam cushioning can supplement the air pad. Foam can act as a backup for the air. The air cushioning combined with foam cushioning also can provide a massaging effect.

Airtight Hollow Body 32

During inflating, airtight hollow body 32 forms a geometrically efficient arching configuration as it conforms to the contours of resilient structure member 30. (The top and bottom sections may need to be pulled apart occasionally.) During inflating, the airtight chamber forms the geometrically efficient shapes of arches and domes because it is comprised of flexible material. Airtight hollow body 32 traps air inside its walls.

When a load is applied to top section 34, it deforms. This deformation occurs because top section 34 comprises flexible material. Top section 34 deforms, to an extent, to the contours of the load's touching surface. Airtight hollow body 32's flexible materials also allow for collapsibility.

In its expanded, inflated state, airtight hollow body 32 has a high volume relative to its surface area and plan dimensions. As airtight hollow body 32 deforms, its internal volume diminishes. This causes the pressure of the trapped air to increase. The pressure should eventually match the weight per unit area of the supported item.

In the preferred design top section 34 has curved, vertical cross-sections, but base section 36 does not. There are two reasons for this. First, if base section 36 is curved then the air pad may be less stable. Second, if both top and base sections are curved then the expanding and inflating may be less reliable. When resilient structure member 30 is hollow, there can be a tendency for a section to bend out the wrong way.

Valve 48

Valve 48 controls the flow of air through hollow body opening 47 in airtight hollow body 32. During inflating, valve 48 permits the free flow of air into the airtight chamber through this opening.

When the air pad is used, valve 48 prevents the air from escaping through this opening. However, valve 48 may allow air to escape through hollow body opening 47 during a deflating phase.

Miscellaneous

Stiffened sections 51 at end sections **38*a* and 38*b* can supplement resilient structure member 30's inflating capability. This can be done by grasping and erecting the stiff end sections. When rigid end sections 38*a* and 38*b*** are pulled apart or erected, this will cause arch shaped embodiments to form their geometrically efficient arching configuration. This provides a backup or supplemental inflating method.

Stiffened section(s) 51 at base section 36 can provide a firm backing for the air pads. For example, the invented air pads could be useful on chairs as lumbar supports. If a chair were heavily slitted or open at the lumbar region, a rigid base section could provide the needed backing. Stiffened sections 51 also can provide a backing for valve 48. Such a rigid backing could be especially useful for a push button valve.

Supplementary material 52 can enhance the geometrically efficient self-inflating air pad in many ways. Supplementary material 52 may serve to give the supporting surface a particular feel. Alternatively, supplementary material 52 could be used to make airtight hollow body 32 less elastic. Supplementary material 52 also could be added simply for aesthetics or advertising.

Storage strap 50 serves to counteract the expanding effect of resilient structure member 30. This is useful for storage or travel. A bag or other encasing means can be used for maintaining compactness in a deflated configuration.

Encasing straps or jacket 56 can serve to even out the peaks and valleys of multi-unit embodiments. Encasing jackets or straps also can serve to bind unconnected units together.

THEORY OF OPERATION

General Discussion

The major key to the present air-pad invention is the application of airtight hollow bodies that have geometrically efficient, vertical cross-sections. Geometric efficiency is defined for a two-dimensional shape as the shape's surface area divided by corresponding rectangle 42's surface area. Again, corresponding rectangle 42 is the rectangle with equal perimeter and equal width, where width is defined as the shape's biggest dimension. To clearly define a shape's surface area and perimeter the shape must be "closed". The foregoing is the technical definition of geometric efficiency.

This translates into airtight chambers that have high volumes in their expanded states relative to their volumes when they are flattened. During, the flattening process the air pads maintain, for the most part, their plan dimensions. Without this restriction air pads could be flattened until their volumes reached zero.

Thus flattening means flattening without extending plan dimensions. In the disclosed air pads, the ratio of the airtight chamber's volume in its expanded configuration to its volume when flattened is high. In other words, the volume of airtight hollow body 32 in its geometrically evident arching configuration diminishes greatly when it is flattened.

Maintaining plan dimensions is important for several reasons. Often there will not be room for the air pad to spread. This is likely to be the case in a stadium cushion. Usually, the designer needs to confine the air pad to a particular area. This is likely to be the case in shoes and in most other applications. Maintaining plan dimensions helps the user corral and compress the inflating fluid. It can prevent the bunching of material. Finally, it can enhance stability.

The comparison of expanded volumes to flattened volumes is important because, on average, air pads will be used in a flattened configuration. An air pad in a shoe will deform into a somewhat arched shape, but a stadium cushion probably would take on a bowed shape. However, on average these air pads are almost flattened.

In the field of self-inflating air pads, the prior art usually creates fiat pads because of this. Since the air pad is going to be used in a generally flattened configuration, so the thinking goes, we should create a generally flat air pad. The invented air pad goes against this type of thinking. It recognizes that a self-inflating air pad does not need to be and should not be flat or boxy.

It has been found that relatively small arcs of a circle, with their endpoints closed by a straight line, are very geometrically efficient. It is believed that the most geometrically efficient shapes comprise arcs of a circle, although other curves can function very well. The following mathematical analyses calculate and illustrate geometric efficiencies of various arching shapes that comprise arcs of a circle. Then the importance of geometric efficiency is shown.

Symbol Definitions

The following symbols are used in the calculations and illustrations of geometric efficiencies. The reader should use this list for reference.

$\lambda$=Geometric efficiency.

A=Area of geometrically efficient arching shape 40.

$A_r$=Area of corresponding rectangle 42.

W=Width of geometrically efficient arching shape 40 and, by definition, width of corresponding rectangle 42.

$h_r$=Height of corresponding rectangle 42.

P=Perimeter of geometrically efficient arching shape 40 and, by definition, perimeter of corresponding rectangle 42.

R=Radius of circle.

$A_t$=Where applicable, the area of the triangle formed by the line segment connecting a circular arc's endpoints and the radii to the arc's endpoints.

$A_s$=A+$A_t$ where applicable.

$h_t$=Height of above described triangle.

$b_t$=Base of above described triangle.

Geometric Efficiency of Semicircle

Below geometric efficiency is calculated for a semicircle. Again geometric efficiency of a two-dimensional shape is its surface area divided by the surface area of its corresponding rectangle. The corresponding rectangle is the rectangle with equal width and equal perimeter, where the width of a shape is its widest dimension.

Figure 22:
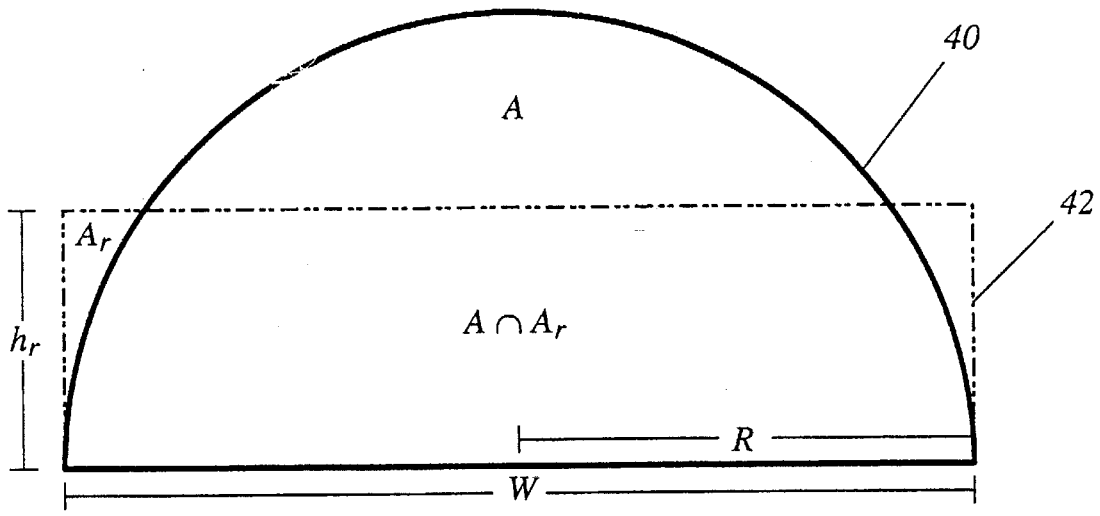
FIGS. 22–26 are vertical, cross-sectional views illustrating theoretical analyses of the disclosed self-inflating air pad.

FIG. 22 is a graphical presentation of the geometric efficiency of a semicircle. FIG. 22 shows a semicircle, which is mildly geometrically efficient arching shape 40. FIG. 22 shows arching shape 40's corresponding rectangle 42. The phantom lines indicate that arching shape 40 deforms into corresponding rectangle 42. Arching shape 40 represents a possible, vertical cross-section of airtight hollow body 32 in its expanded state.

$$\text{Clearly, } A = \frac{1}{2}\ (\text{Area of circle}) = \frac{1}{2}\ \pi R^2 = R^2\frac{\pi}{2}\ W = 2R$$

$$P = \text{Perimeter of semicircle} = \frac{1}{2}\ (\text{Perimeter of circle}) +$$

$$W = \frac{1}{2}\ 2\pi R + 2R = \pi R + 2R$$

$$P = \text{Perimeter of corresponding rectangle} =$$

$$2h_r + 2W = 2h_r + 4R$$

equating these expressions for $P$, $\pi R + 2R =$ $$2h_r + 4R \Longrightarrow h_r = R\left(\frac{\pi}{2} - 1\right)$$

$$\text{Clearly, } A_r = Wh_r = 2RR\left(\frac{\pi}{2} - 1\right) = R^2(\pi - 2)$$

$$\lambda = \frac{A}{A_r} = \frac{R^2\frac{\pi}{2}}{R^2(\pi - 2)} \approx 1.376$$

CONCLUSION: A semi-circle has a geometric efficiency of 1.376 rounded to three decimal places. In other words, a semi-circle has approximately 37.6% more area than its corresponding rectangle. This is the rectangle into which the semicircle could deform while keeping the same base. It is important to notice that R drops out of the final equation which means that this analysis is independent of scale.

FIG. 22 is dram to scale. In the drawing, the perimeters of the semicircle and its corresponding rectangle 40 are equal. However, the semicircle's perimeter can appear greater than the perimeter of its corresponding rectangle. This is an optical illusion. The optical illusion occurs when one imagines deforming the semicircle into its corresponding rectangle. The fact that A is greater in surface area than $A_r$ creates the optical illusion.

Geometric Efficiency of 120° Arc and Secant

Below geometric efficiency is calculated for a 120° arc and its secant. The 120° arc is the curve that travels one third the way around a circle. The secant is the line segment connecting the endpoints of an arc. The are and secant is clearly a single arching shape as previously defined. Observe that an are by itself is open. An open shape does not have a clearly defined surface area and perimeter. To dearly define its perimeter and surface area, a shape must be closed. The secant closes the arc.

Figure 23:
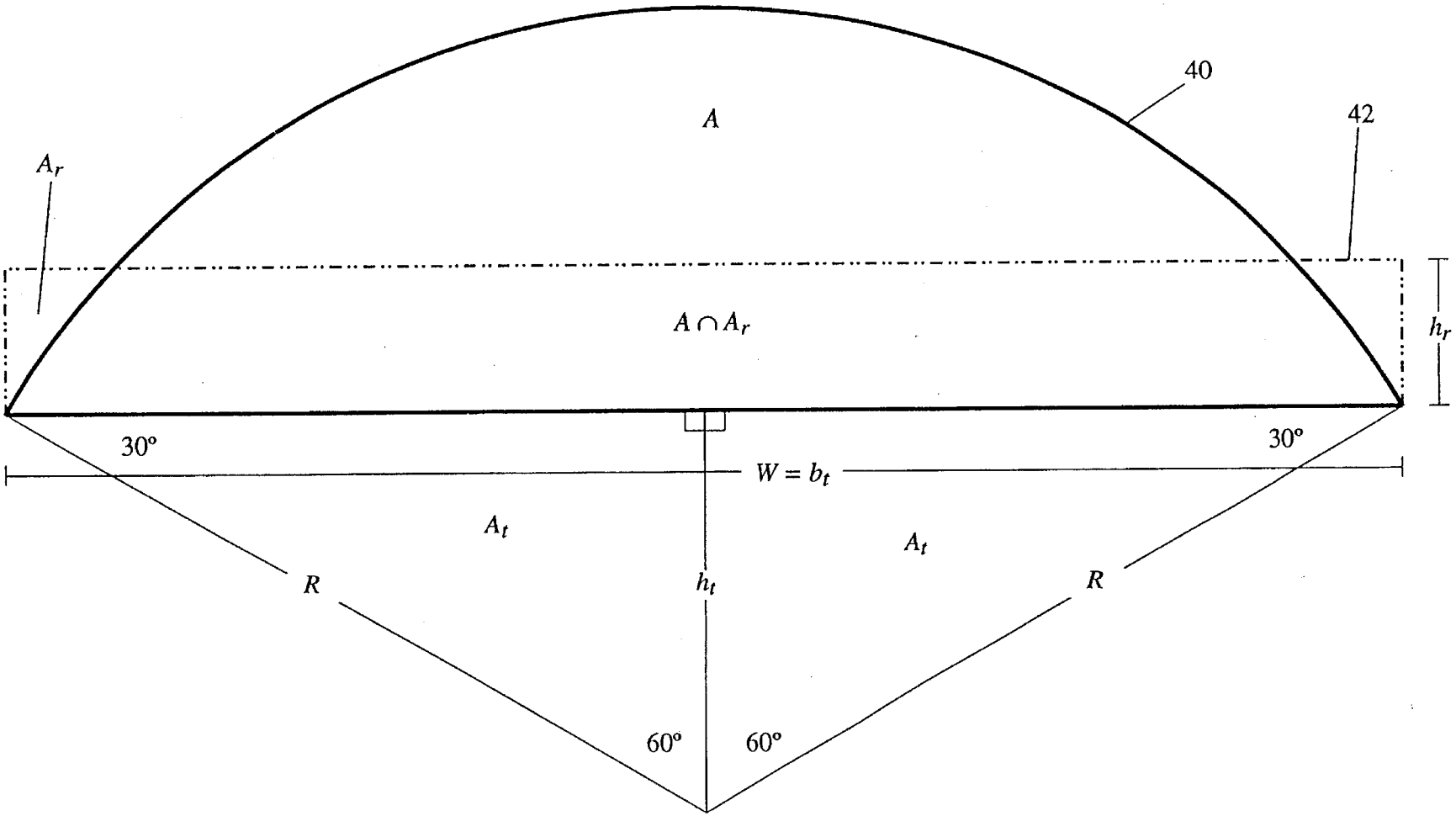

FIG. 23 is a graphical presentation of the geometric efficiency of a 120° arc and secant. The 120° arc and secant is geometrically efficient arching shape 40. FIG. 23 shows geometrically efficient arching shape 40's corresponding rectangle. Again, the phantom lines indicate that geometrically efficient arching shape 40 deforms into corresponding rectangle 42.

The are itself represents the top section of an airtight hollow body's vertical cross-section. The secant represents the base section of an airtight hollow body's vertical cross-section. The equality of perimeters expresses that the airtight hollow body material does not stretch significantly as it deforms. The equality of widths indicates that plan dimensions are substantially maintained.

From geometry: $h_t = \frac{R}{2}$ $W = b_t = R\sqrt{3}$ $A_t = \frac{b_t h_t}{2} = R^2 \frac{\sqrt{3}}{4}$ $A_s = \frac{1}{3}$ (Area of circle) $= \frac{\pi R^2}{3}$ $$A = A_s - A_t = \frac{\pi R^2}{3} - R^2 \frac{\sqrt{3}}{4} = R^2\left(\frac{\pi}{3} - \frac{\sqrt{3}}{4}\right)$$

$P$ = Perimeter of shape $= \frac{1}{3}$ (Perimeter of circle) + $W$ =

$$\frac{2\pi R}{3} + R\sqrt{3}$$

$P$ = Perimeter of corresponding rectangle = $2h_r + 2W$ =

$$2h_r + 2R\sqrt{3}$$

equating expressions for $P$, $\frac{2\pi R}{3} + R\sqrt{3} =$ $$2h_r + 2R\sqrt{3} \Longrightarrow h_r = R\left(\frac{\pi}{3} - \frac{\sqrt{3}}{2}\right)$$

Clearly, $A_r = Wh_r = R^2\left(\frac{\pi\sqrt{3}}{3} - \frac{3}{2}\right)$ $$\lambda = \frac{A}{A_r} = \frac{R^2\left(\frac{\pi}{3} - \frac{\sqrt{3}}{4}\right)}{R^2\left(\frac{\pi\sqrt{3}}{3} - \frac{3}{2}\right)} \approx 1.96$$

CONCLUSION: A 120° arc and secant has a geometric efficiency of 1.96 rounded to two decimal places. In other words, this shape has almost double the surface area of its corresponding rectangle. FIG. 23 shows this. Again, R drops out of the final equation which means that this analysis is independent of scale.

Geometric Efficiency of 90° Arc and Secant

Below geometric efficiency is calculated for a 90° arc and its secant. The 90° arc is the curve that travels one quarter the way around a circle. The secant is the line segment connecting the endpoints of the arc.

Figure 24:
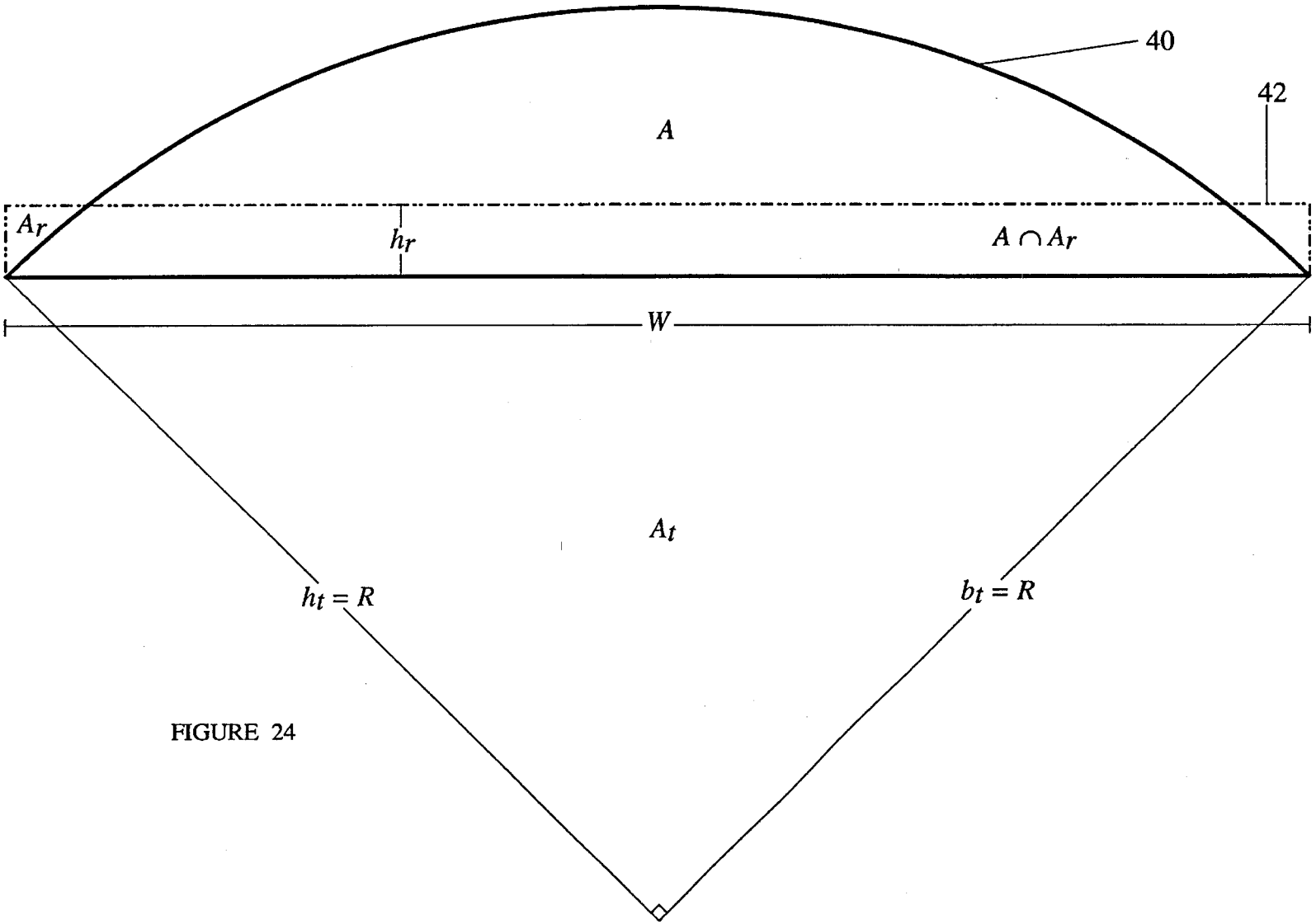

FIG. 24 is a graphical presentation of the geometric efficiency of a 90° arc and secant. The 90° arc and secant is geometrically efficient arching shape 40. FIG. 24 shows geometrically efficient arching shape 40's corresponding rectangle 42. The diagram is again drawn to scale.

Clearly, $h_t = b_t = R$ $W = R\sqrt{2}$ because isosceles right triangle $A_t = \frac{b_t h_t}{2} = \frac{R^2}{2}$ $A_s = \frac{1}{4}$ (Area of circle) $= \frac{1}{4}\pi R^2$ $$A = A_s = A_t = \frac{1}{4}\pi R^2 - \frac{R^2}{2} = R^2\left(\frac{\pi}{4} - \frac{1}{2}\right)$$

$P$ = Perimeter of shape $= \frac{1}{4}$ (Perimeter of circle) + $W$ =

$$\frac{1}{4}2\pi R + R\sqrt{2} = \frac{\pi}{2}R + R\sqrt{2}$$

$P$ = Perimeter of corresponding rectangle = $2h_r + 2W$ =

-continued $$2h_r + 2R\sqrt{2}$$

equating expressions for $P$, $\frac{\pi}{2}R + R\sqrt{2} = 2h_r +$ $$2R\sqrt{2} \Longrightarrow h_r = R\left(\frac{\pi}{4} - \frac{\sqrt{2}}{2}\right)$$

Clearly, $A_r = Wh_r = R^2\left(\pi\frac{\sqrt{2}}{4} - 1\right)$ $$\lambda = \frac{A}{A_r} = \frac{R^2\left(\frac{\pi}{4} - \frac{1}{2}\right)}{R^2\left(\pi\frac{\sqrt{2}}{4} - 1\right)} \approx 2.58$$

CONCLUSION: A 90° arc and its secant has a geometric efficiency of 2.58 rounded to two decimal places. In other words, this shape has over two and a half times the surface area of its corresponding rectangle. FIG. 24 shows this dramatic difference in areas. This analysis is again independent of scale.

Geometric Efficiency of 60° Arc and Secant

Below geometric efficiency is calculated for a 60° arc and its secant. The 60° arc is the curve that travels one sixth the way around a circle. The secant closes the arc.

Figure 25:
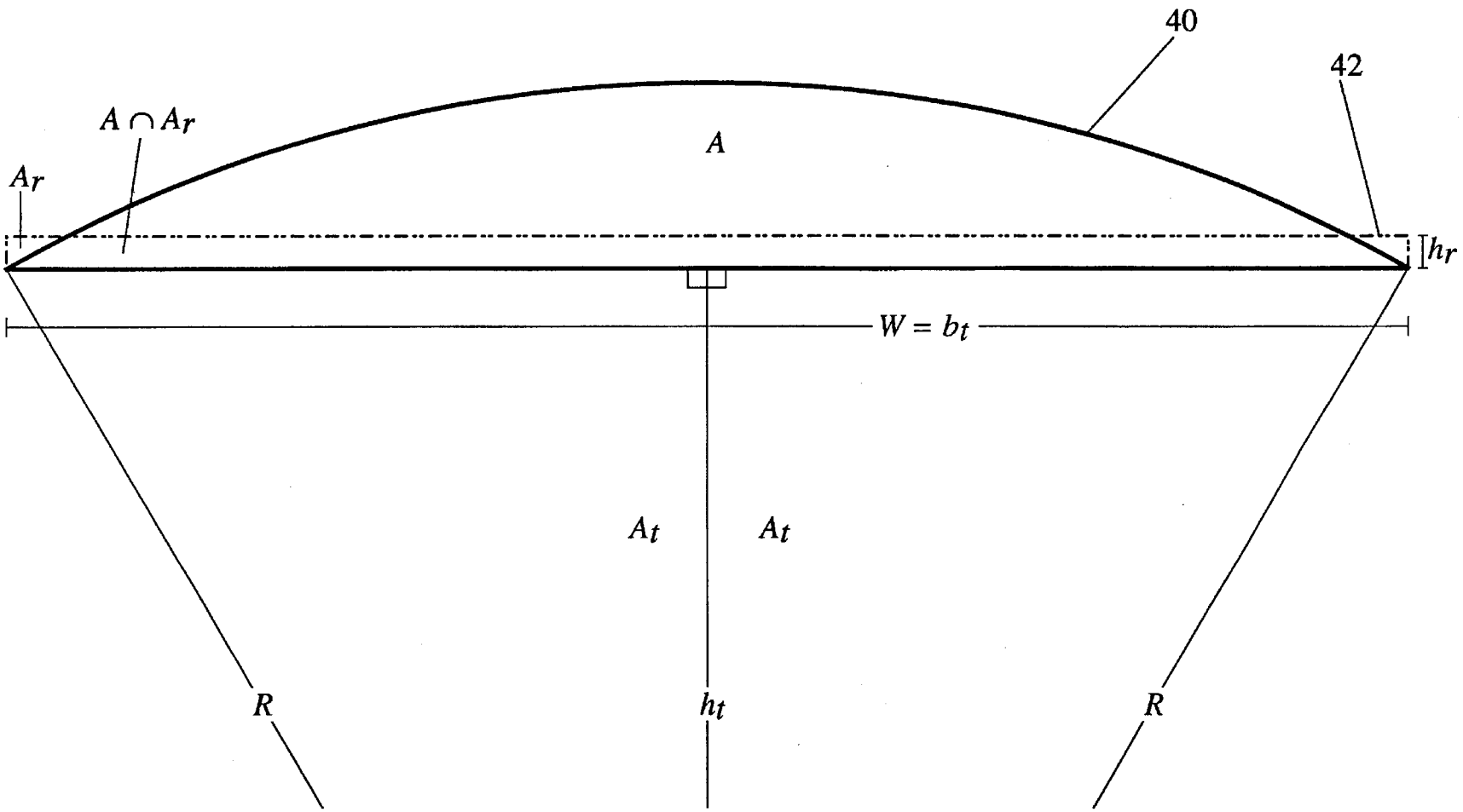

FIG. 25 is a graphical presentation of the geometric efficiency of a 60° arc and its secant. The 60° arc and secant is geometrically efficient arching shape 40. FIG. 25 shows geometrically efficient arching shape 40's corresponding rectangle 42. The diagram is again drawn to scale. It is surprising how thin corresponding rectangle 42 is when the geometrically efficient shape's are is flattened.

$W = b_t = R$ because equilateral traingle $h_t =$ $$R\frac{\sqrt{3}}{2} \text{ from geometry}$$

$A_t = \frac{b_t h_t}{2} = R^2\frac{\sqrt{3}}{4}$ $A_s = \frac{1}{6}$ (Arear of circle) $= \frac{\pi R^2}{6}$ $$A = A_s - A_t = \frac{\pi R^2}{6} - R^2\frac{\sqrt{3}}{4} = R^2\left(\frac{\pi}{6} - \frac{\sqrt{3}}{4}\right)$$

$P$ = Perimeter of shape $= \frac{1}{6}$ (Perimeter of circle) +

$$W = \frac{2\pi R}{6} + R = \frac{\pi}{3}R + R$$

$P$ = Perimeter of corresponding rectangle =

$$2h_r + 2W = 2h_r + 2R$$

equating expressions for $P$, $\frac{\pi}{3}R + R = 2h_r +$ $$2R \Longrightarrow h_r = R\left(\frac{\pi}{6} - \frac{1}{2}\right)$$

Clearly, $A_r = Wh_r = R^2\left(\frac{\pi}{6} - \frac{1}{2}\right)$

-continued $$\lambda = \frac{A}{A_r} = \frac{R^2\left(\frac{\pi}{6} - \frac{\sqrt{3}}{4}\right)}{R^2\left(\frac{\pi}{6} - \frac{1}{2}\right)} \approx 3.84$$

CONCLUSION: A 60° arc and secant has a geometric efficiency of 3.84 rounded to two decimal places. In other words, this shape has well over three and a half times the surface area of its corresponding rectangle. FIG. 25 shows this striking difference in areas. This analysis is again independent of scale.

Observe that as the circular arcs have gotten smaller in terms of degrees, the geometric efficiency has increased. This alone is unobvious. Moreover, the geometric efficiency increases exponentially. This is even more unobvious. This process can theoretically go out to infinity; however, practical applications will limit geometric efficiency.

Geometric Efficiency of Double 60° Arc

Figure 26:
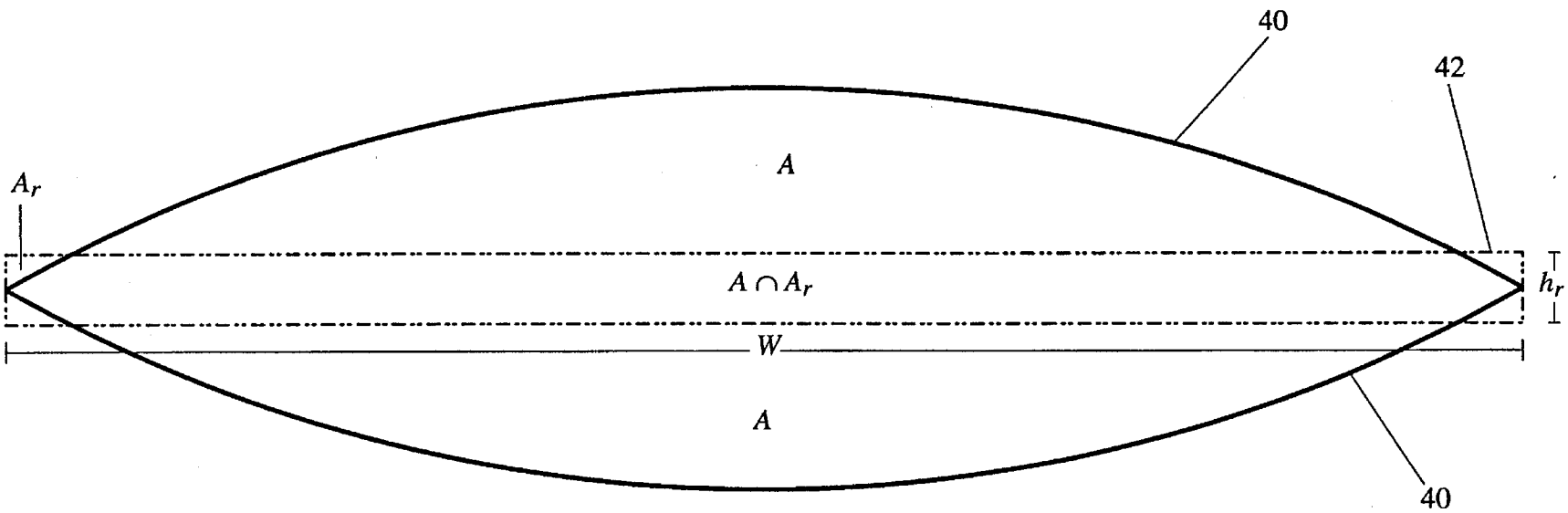

In FIG. 26, geometrically efficient arching shape 40 is a double 60° arc. The double 60° arc has a 60° arc opening onto a second 60° arc, the two connecting at their endpoints. Notice that the second are closes the shape instead of the secant. No secant is present in FIG. 26. This corresponds to a geometrically efficient self-inflating air pad not having a flat base.

FIG. 26 shows geometrically efficient arching shape 40's corresponding rectangle 42. The diagram is again drawn to scale. The geometric efficiency of this shape is dear from the drawing. The surface area of corresponding rectangle 42 is much smaller than that of geometrically efficient arching shape 40.

Next geometric efficiency is determined for the double 60° arc. The surface area of geometrically efficient arching shape 40 in FIG. 26 is double the surface area of geometrically efficient arching shape 40 in FIG. 25. This simply is because there are two arcs instead of one.

The reader also can see that the area of corresponding rectangle 42 doubles from FIG. 25 to FIG. 26. This is because the arc itself in FIG. 25 provides the area to its corresponding rectangle. The secant simply closes the corresponding rectangle. Since there are two such arcs in FIG. 26, the surface area of the corresponding rectangle doubles.

Because A and $A_r$ are both doubled, $\lambda = A \div A_r$ remains unchanged. The geometric efficiency of a double 60° arc is also 3.84 rounded to two decimal places.

This relationship holds true for other double arcs. The geometric efficiency for a single arc and secant is the same as for the double arc. Seen another way, geometrically efficient arching shape 40 can have a flat base without sacrificing geometric efficiency.

The next part shows how the concept of geometric efficiency pertains to volume factors. Afterwards, the concept of volume factors is related to the weight supporting capacities of the disclosed air pads.

Geometric Efficiency and Volume Factors

Consider the self-inflating air pad of FIG. 1. Airtight hollow body 32 is in its expanded/inflated state. Transverse, vertical cross-sections of airtight hollow 32 body are all substantially equal in shape. This two-dimensional shape is geometrically efficient arching shape 40. The volume of airtight hollow body 32 is the surface area of geometrically efficient arching shape 40 times airtight hollow body 32's longitudinal dimension. This is the inflated volume.

Now, imagine that top section 34 is flattened to form a rectangular box with the same plan dimensions. Ignore for the moment what happens to end sections 38*a* and 38*b*. Then transverse cross-sections of airtight hollow body 32 are now corresponding rectangles 42. The new volume of airtight hollow body 32 is the surface area of corresponding rectangle 42 again times airtight hollow body 32's longitudinal dimension. This is approximately the flattened volume.

The number of times the inflated volume is greater than the flattened volume is:

$$\frac{\text{inflated volume}}{\text{flattened volume}} = \frac{A \times \text{longitudinal dimension}}{A_r \times \text{longitudinal dimension}} = \frac{A}{A_r} = \lambda.$$

Therefore, in this situation, geometric efficiency represents how many times the inflated volume is greater than the flattened volume. In other words, the volume of airtight hollow body 32 is divided by λ, when it is flattened into its corresponding rectangular box. The number of times an inflated volume is greater than the flattened volume is the definition of volume factor.

In truth, the geometric efficiency is not exactly the volume factor. The airtight hollow body would not deform exactly into a rectangular box. The end sections would increase the flattened volume in some way. They would bow out if they were flexible. If they were rigid, top section 34 could not deform into a rectangular shape at the ends. Nevertheless, λ, can be used to approximate the decrease in volume.

The volume factor, not geometric efficiency of cross-sections, is ultimately the quantity of interest. Geometric efficiency only gauges the volume factor value. Geometric efficiency is used to make the analysis more tractable. Calculating volumes can be difficult or impossible. For example, it is probably impossible to predict exactly how the air pad in FIG. 1 will deform. Therefore, it is probably impossible to calculate the flattened volume. Fortunately, geometric efficiencies can provide a good indication whether a volume can have a high volume factor.

The air pad in FIG. 1 can decrease in volume without substantially altering its plan dimension because all the vertical, transverse cross-sections have a high geometric efficiency. From a calculus viewpoint, the air pad has an infinite number of geometrically efficient cross-sections. Similarly, the air pad in FIG. 11 can have a high volume factor because vertical, transverse cross-sections all have a high geometric efficiency. For the air pad in FIG. 10, the vertical cross-sections that fan between end sections 38*a* and 38*b* have high geometric efficiencies. Therefore, we can conclude that there will be a proportionately large volume decrease if top section 34 is flattened.

As noted previously, virtually all vertical cross-sections of dome shaped embodiments have high geometric efficiencies. Therefore, one can infer that dome shaped embodiments will lose a proportionately huge amount of volume when flattened to a shape with the same plan dimensions.

Notice that in arch shaped embodiments, deformation occurs substantially in two dimensions. A vertical, transverse cross-section can deform directly into its corresponding rectangle. On the contrary, in dome shaped embodiments, deformation into flattened shapes generally occurs in three dimensions. When dome shaped air pads are flattened, vertical cross-sections do not deform directly into their corresponding rectangles.

Nevertheless, it is the infinite number of geometrically efficient cross-sections that causes dome shaped embodiments to have high volume factors. This can be shown with analytic geometry and calculus. It can be shown that a 60° degree section of a sphere has 3.82 times the volume of a cylinder with the same surface area and the same circular plan dimensions. Notice that this 3.82 is very close to the 3.84 calculated for the geometric efficiency of a 60° arc. These figures differ by less than a 1%. This demonstrates the strong relationship between geometric efficiencies of vertical cross-sections and volume factors.

Observe that, analogously, a 60° section of a sphere forms 60° arcs and secants in vertical cross-section. Also analogously, the vertical cross-sections of a cylinder form rectangles.

The next part relates the concept of volume factors to weight supporting capacities. The reader will see how a decrease in volume in the disclosed self-inflating air pads upholds weight.

Volume Factors and Weight Supporting Capacity

Below, the weight bearing capacity of the encompassed air pads is analyzed. The analysis shows how volume, pressure, and support surface areas relate to weight support capacity. This section calculates how effective the presented air pads can be. The discussion below explains how much weight can be supported as volume in a chamber diminishes and as weight is distributed over surface area. Because this question has many variables, it is difficult to provide exact numerical results. Therefore, the analysis will instead provide ranges of results.

V=Initial volume of inflating chamber.

μ=Volume factor—the number of times initial volume is greater than deformed volume.

Q=Atmospheric pressure. The pressure outside the chamber. The pressure inside the chamber before it is deformed.

Q'—Pressure inside chamber after chamber is deformed.

$A_F$=Horizontal surface area over which force or weight is distributed.

F=Force or weight that can be supported given all other information.

$$QV = Q'\frac{V}{\mu} \Longrightarrow Q' = \mu Q$$

This is true because pressure times volume is constant inside a fluid chamber, assuming no change in temperature and amount of fluid. As volume decreases pressure proportionately increases.

From physics, $F=(Q'-Q)A_F$

This equation says that the difference in pressure inside and outside a chamber multiplied by the horizontal area of contact equals the weight that can be supported.

Substituting, $F=(\mu Q-Q)A_F=Q(\mu-1)A_F$.

NOTE: See the Support Capacity Table listing values of F for various μ's and $A_F$'s.

CONCLUSION: The results show that the weight supporting capacity of the geometrically efficient, self-inflating pads can be very substantial. A particular application will dictate what shape and geometry is most suitable. The shapes presented here or minor variations of these shapes should be adequate to satisfy most applications. In practice, designs should be over-engineered since fluid can easily be expelled from a chamber if over-inflating occurs. Also, since weight supporting capacity is proportional to atmospheric pressure, designs involving air should be over-engineered to ensure proper functioning at high altitudes.

A key to understanding the geometrically efficient self-inflating air pad is realizing that the amount of air is not what is wholly critical. What is important is how much the air is compressed. This is one reason low arching shapes can be especially supportive, contrary to intuition.

Low arches and low domes can be especially supportive for another reason. These shapes provide a wider support surface area. Assuming weight is distributed over the wider surface area, then the effects of low arcs can be even more dramatic.

The volumes described in the disclosed invention can have flat bases. As shown, the geometric efficiency of shapes with flat bases can be as high as shapes with convex bases. As a result, the encompassed air pads can have flat bases and still have equally high volume factors while maintaining plan dimensions. Having a flat base is desirable for stability and other reasons.

Support Capacity Table

The table below shows weights that will be supported given various supporting surface areas and various volume factors. The units of $A_F$ are given in square inches. The weights, the values inside the table, are in pounds. These are calculated by applying the formula: $F = Q(\mu - 1) A_F$. In this table Q is assumed to be 14.7 lbs/in$^2$.

| | μ | | | | | | | | |
|---|---|---|---|---|---|---|---|---|---|
| $A_F$ | 1.25 | 1.376 | 1.5 | 1.74 | 2 | 2.58 | 3 | 3.84 | 5 |
| 1 | 3.68 | 5.53 | 7.35 | 10.88 | 14.70 | 23.23 | 29.40 | 41.75 | 58.80 |
| 4 | 14.70 | 22.11 | 29.40 | 43.51 | 58.80 | 92.90 | 118 | 167 | 235 |
| 9 | 33.08 | 49.74 | 66.15 | 97.90 | 132 | 209 | 265 | 376 | 529 |
| 36 | 132 | 199 | 265 | 392 | 529 | 836 | 1,058 | 1,503 | 2,117 |
| 81 | 298 | 448 | 595 | 881 | 1,191 | 1,881 | 2,381 | 3,382 | 4,763 |
| 144 | 529 | 796 | 1,058 | 1,566 | 2,117 | 3,345 | 4,234 | 6,012 | 8,467 |
| 216 | 794 | 1,194 | 1,588 | 2,350 | 3,175 | 5,017 | 6,350 | 9,018 | 12,701 |
| 288 | 1,058 | 1,592 | 2,117 | 3,133 | 4,234 | 6,689 | 8,467 | 12,023 | 16,934 |
| 432 | 1,588 | 2,388 | 3,175 | 4,699 | 6,350 | 10,034 | 12,701 | 18,035 | 25,402 |
| 720 | 2,646 | 3,980 | 5,292 | 7,832 | 10,584 | 16,723 | 21,168 | 30,059 | 42,336 |

Issues that Affect Results

The analyses presented must not be construed too strictly. This subsection highlights the analytical assumptions that will vary in practice.

In practice the expanding/inflating action will not form perfect initial shapes. However, if an inflating chamber is constructed without slack material, the shapes can be very close approximations.

If resilient structure member 30 is internal, it will occupy some space that cannot be occupied by the inflating fluid.

However, the space occupied by resilient structure member 30 is expected to be fairly negligible. The preferred embodiment is for open celled materials that are hollow.

The pressure inside airtight hollow body 32 may not quite reach atmospheric pressure. This will depend on various factors. The size of hollow body opening 47 will play a role. The amount of time valve 48 permits inflating fluid to enter airtight hollow body 32 is a factor.

Atmospheric pressure is assumed to be 14.7 lbs/in$^2$. This factor varies slightly from day to day along with changes in weather. More importantly, this factor may be noticeably lower at high altitudes.

It is difficult to predict exactly what the volume factor will be. This is because it is difficult to predict exactly what the deformed volume will be. It is obvious that the initial shapes would not deform exactly into shapes with rectangular cross-sections. Depending upon the weight and geometry of that which is being supported, sections of the air pad would likely deform into shapes even less efficient. The rectangular shape is useful as an average shape that is simple to analyze. Also, the rectangular shape, essentially a benchmark, is useful in comparing the prior art. The air pad will deform and the volume factor will increase until the pressure and weight balance.

It is usually difficult to predict exactly how a weight would rest upon the air pad. In other words, $A_F$ is an unknown variable parameter. If a weight is spread over a large surface area it should be well supported. If the same weight is concentrated on a small spot, the air pad may not work. For most applications it is a matter of selecting the right geometry to get adequate support. However, in some applications an intervening layer that spreads the weight may be desirable or necessary. For example, a flat plate could be positioned between a self-inflating packing pad and cargo to spread its weight.

Other simplifying assumptions have also been made. For example, it is assumed that the chamber itself has no weight. However, these other considerations are generally negligible. The presented analysis provides a person skilled in the art the information to apply the geometrically efficient, self-inflating air pads.

RAMIFICATIONS AND SCOPE

The geometrically efficient self-inflating air pad presented here can be used in a wide range of applications. The air pads of the present invention have many advantages over the prior art. Conventional prior art relies on unhygienic blow-up valves or cumbersome pumps.

Prior art relating to self-inflating air pads has concentrated on relatively inefficient geometry. By utilizing geometrically efficient shapes, the air pads have greater weight support capacities. These air pads also can maintain their plan dimensions.

The description above contains many specificities. These should not be construed as limiting the scope of the invention but as merely providing illustrations of some presently preferred embodiments of the invention. It is assumed that air will be the inflating fluid; however, other inflating fluids may replace air.

The top section of the air pads shown often has a convex curve while the base section is flat. It should be recorded that the top section always could be flat while the base section is curved.

The resilient structure member also may be incomplete in places. It may, for example, have a lattice structure and still rebound to its original shape.

Geometrically efficient arching shape 40 may approximate a curve. Instead of being truly curved, geometrically efficient arching shape 40 may comprise a series of line segments with different slopes. These line segments can be said to form a choppy are. A true curve has a continuously changing slope.

A second valve may be added expressly for deflating. This would be especially convenient if the first valve were a check valve.

Thus the scope of the invention should be determined by the appended claims and their legal equivalents, rather than by the examples given.

Having thus described my invention, I claim:

1. A substantially self-inflatable seat cushion comprising:

a substantially airtight hollow body(32) comprising a top section(34) and a base section(36) with one of said sections being planar and the other of said sections being arched, said sections being interconnected in airtight relation along a border, the airtight hollow hotly(32) comprising substantially flexible material so that the airtight hollow body(32) has a highly geometrically efficient single arching configuration, which means having a central vertical cross-section that has a highly geometrically efficient single arching shape(40), defined as a shape having a substantially curved portion, as a shape having a substantially straight portion closing the endpoints of the curved portion, and as a shape having a surface area greater than or equal to 2.25 times the surface area of a corresponding rectangle(42), where said corresponding rectangle(42) is the rectangle with equal perimeter and equal width, where width is defined as the geometrically efficient shape(40)'s biggest dimension;

a substantial hollow(31), which is a substantially homogeneous air fillable cavity inside the airtight hollow body(32);

a resilient structure member(30), that substantially contacts and lines the curved portion of the geometrically efficient arching shape(40) of the airtight hollow body(32), whereby said resilient structure member(30) substantially surrounds the hollow(31), said resilient structure member(30) defining a springy frame that substantially causes the cross-section of the airtight hollow body to have said highly geometrically efficient single arching shape(40) during inflating, whereby the airtight hollow body(32) has said highly geometrically efficient single arching configuration;

a valvular means(48) in communication with the interior of the airtight hollow body(32), to allow air to enter the airtight hollow body(32) during inflating, but to substantially prevent air from escaping the airtight hollow body(32) during use of the self-inflatable seat cushion.

2. The seat cushion of claim 1 such that said highly geometrically efficient single arching shape(40) has a surface area greater than or equal to 3 times the surface area of said corresponding rectangle(42) but less than 3.5 times the surface area of said corresponding rectangle(42).

3. The seat cushion of claim 1 such that said highly geometrically efficient single arching shape(40) has a surface area greater than or equal to 3.5 times the surface area of said corresponding rectangle(42).

4. The seat cushion of claim 1 where the airtight hollow body(32) has a relatively upright and distinct end section(38) terminating its left side and symmetrically has a relatively upright and distinct end section(38) terminating its right side, such that the left and right end sections(38) stand at a marked angle to each other, whereby the seat cushion's breadth directly from left to right increases substantially from from to back.

* * * * *